US006247806B1

(12) United States Patent
Matsumoto et al.

(10) Patent No.: US 6,247,806 B1
(45) **Date of Patent: *Jun. 19, 2001**

(54) LIQUID EJECTION HEAD CARTRIDGE AND LIQUID CONTAINER USABLE THEREWITH

(75) Inventors: Hidehisa Matsumoto, Kawasaki (JP); Toshiaki Sasaki, Irvine, CA (US); Hiroyuki Ishinaga, Tokyo (JP); Toshio Kashino, Chigasaki (JP); Kiyomitsu Kudo, Kawasaki (JP); Yoshie Asakawa, Nagano-ken (JP); Hiroaki Mihara, Musashino (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/886,429

(22) Filed: Jul. 1, 1997

(30) Foreign Application Priority Data

| | | |
|---|---|---|
| Jul. 1, 1996 | (JP) | 8-171027 |
| Jul. 4, 1996 | (JP) | 8-174828 |
| May 23, 1997 | (JP) | 9-133524 |

(51) Int. Cl.[7] ..... B41J 2/175

(52) U.S. Cl. ..... 347/87

(58) Field of Search ..... 347/56, 62, 65, 347/85, 86, 87, 20, 30, 51, 59, 61

(56) References Cited

U.S. PATENT DOCUMENTS

| | | | | |
|---|---|---|---|---|
| 4,337,467 | * | 6/1982 | Yano | 347/56 |
| 4,480,259 | * | 10/1984 | Kruger et al. | 347/63 |
| 4,509,062 | | 4/1985 | Low et al. | 347/87 |
| 4,723,129 | | 2/1988 | Endo et al. | 347/56 |
| 4,723,136 | * | 2/1988 | Suzumura | 347/65 |
| 4,816,093 | | 3/1989 | Robbins, III | 156/69 |

(List continued on next page.)

FOREIGN PATENT DOCUMENTS

| | | |
|---|---|---|
| 436047 | 7/1991 | (EP) . |
| 493978 | 7/1992 | (EP) . |
| 543315 | 5/1993 | (EP) . |
| 560398 | 9/1993 | (EP) . |
| 661160 | 7/1995 | (EP) . |
| 721841 | 7/1996 | (EP) . |

(List continued on next page.)

*Primary Examiner*—N. Le
*Assistant Examiner*—Anh T. N. Vo
(74) *Attorney, Agent, or Firm*—Fitzpatrick, Cella, Harper & Scinto

(57) ABSTRACT

A liquid ejection head cartridge includes a liquid ejecting head and a liquid container. The liquid ejection head includes an ejection outlet, a bubble generation region, and a movable member disposed faced to the bubble generation region and displaceable between a first position and a second position further from the bubble generation region than the first position. The movable member moves from the first to the second position by pressure produced by the generation of a bubble to permit expansion of the bubble more in a downstream side closer to the ejection outlet. The liquid container includes a substantially prism-like outer wall provided with a substantial air vent portion and having a corner, and an inner wall having a prism-like shape with outer surfaces substantially equivalent to inside surfaces of the outer wall and having a corner portion corresponding to the corner of the outer wall, the inner wall being separable from the outer wall and defining a liquid accommodating portion for containing liquid, the inner wall further having a liquid supply portion for supplying the liquid out of the liquid accommodating portion to the liquid ejection head. The inner wall has a thickness which is smaller in the corner portion than a thickness of a central portion of the outer surfaces of the inner wall.

26 Claims, 22 Drawing Sheets

U.S. PATENT DOCUMENTS

| | | | | |
|---|---|---|---|---|
| 5,040,001 | | 8/1991 | Dunn et al. | 347/86 |
| 5,159,354 | * | 10/1992 | Hirasawa et al. | 347/65 |
| 5,278,585 | | 1/1994 | Karz et al. | 347/65 |
| 5,400,066 | | 3/1995 | Matsumoto et al. | 347/86 |
| 5,435,452 | | 7/1995 | Nishigami et al. | 215/12.1 |
| 5,440,333 | | 8/1995 | Sykora et al. | 347/87 |
| 5,500,665 | | 3/1996 | Ujita et al. | 347/86 |
| 5,805,188 | * | 9/1998 | Nakajima et al. | 347/87 |

FOREIGN PATENT DOCUMENTS

| | | |
|---|---|---|
| 738605 | 10/1996 | (EP) . |
| 55-81172 | 6/1980 | (JP) . |
| 56-67269 | 6/1981 | (JP) . |
| 61-69467 | 4/1986 | (JP) . |
| 61-93246 | 5/1986 | (JP) . |
| 62-196154 | 8/1987 | (JP) . |
| 63-12427 | 1/1988 | (JP) . |
| 63-199972 | 8/1988 | (JP) . |
| 4267727 | 9/1992 | (JP) . |
| 4339759 | 11/1992 | (JP) . |
| 5-77345 | 3/1993 | (JP) . |
| 5-213372 | 8/1993 | (JP) . |
| 5-213373 | 8/1993 | (JP) . |
| 5-254144 | 10/1993 | (JP) . |
| 6-13099 | 1/1994 | (JP) . |
| 6-27523 | 2/1994 | (JP) . |
| 6-211243 | 8/1994 | (JP) . |
| 6-226993 | 8/1994 | (JP) . |
| WO 91/07240 | 5/1991 | (WO) . |

* cited by examiner

LIQUID EJECTION HEAD CARTRIDGE AND LIQUID CONTAINER USABLE THEREWITH

FIELD OF THE INVENTION AND RELATED ART

The present invention relates to a liquid ejection head cartridge using a liquid ejecting head for ejecting desired liquid by generation of a bubble created by application of thermal energy to the liquid, and a liquid container usable with the cartridge.

Particularly, it relates to a head cartridge using a liquid ejecting head including a movable member which is displace or moved by generation of the bubble, and a liquid container usable with the cartridge.

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image formation. As disclosed in U.S. Pat. No. 4,723,129 and so on, a recording device using the bubble jet recording method comprises an ejection outlet for ejecting the ink, an ink flow path in fluid communication with the ejection outlet, and an electrothermal transducer as energy generating means disposed in the ink flow path.

With such a recording method is advantageous in that, a high quality image, can be recorded at high sped and with low noise, and a plurality of such ejection outlets can be posited at high density, and therefore, small size recording apparatus capable of providing a high resolution can be provided, and color images can be easily formed. Therefore, the bubble jet recording method is now widely used in printers, copying machines, facsimile machines or another office equipment, and for industrial systems such as textile printing device or the like.

With the increase of the wide needs for the bubble jet technique, various demands are imposed thereon, recently.

For example, an improvement in energy use efficiency is demanded. To meet the demand, the optimization of the heat generating element such as adjustment of the thickness of the protecting film is investigated. This method is effective in that propagation efficiency of the generated heat to the liquid is improved.

In order to provide high quality images, driving conditions have been proposed by which the ink ejection speed is increased, and/or the bubble generation is stabilized to accomplish better ink ejection. As another example, from the standpoint of increasing the recording speed, flow passage configuration improvements have been proposed by which the speed of liquid filling (refilling) into the liquid flow path is increased.

Japanese Laid-Open Patent Application No. SHO-63-199972 and so on discloses a flow passage structure shown in FIG. 23, (*a*), (*b*). The flow passage structure or the head manufacturing method disclosed in this publication has been made noting a backward wave (the pressure wave directed away from the ejection outlet, more particularly, toward a liquid chamber 12) generated in accordance with generation of the bubble. This backward wave produces an energy loss since it is not effective to eject the liquid.

FIG. 23, (*a*) and (*b*) disclose a valve 10 spaced from a generating region of the bubble generated by the heat generating element 2 in a direction away from the ejection outlet 11.

In FIG. 23, (*b*), this valve 10, is so manufactured from a plate that it has an initial position where it looks as if it stick on the ceiling of the flow path 3, and is deflected downward into the flow path 3 upon the generation of the bubble. Thus, the energy loss is suppressed by controlling a part of the backward wave by the valve 10.

However, with this structure, if the consideration is made as to the time when the bubble is generated in the flow path 3 having the liquid to be ejected, the suppression of a part of the backward wave by the valve 10 is no desirable.

The backward wave per se is not contributable to the ejection. At the time when the backward wave is generated inside the flow path 3, the pressure directly contributable to the ejection has already made the liquid ejectable from the flow path 3, as shown in FIG. 23, (*a*).

Therefore, even if the backward wave is suppressed, the ejection is not significantly influenced, much less even if a part thereof is suppressed.

On the other hand, in the bubble jet recording method, the heating is repeated with the heat generating element contacted with the ink, and therefore, a burnt material is deposited on the surface of the heat generating element due to burnt deposit (coagulation) of the ink. However, the amount of the deposit may be large depending on the materials of the ink. If this occurs, the ink ejection becomes unstable.

Additionally, even when the liquid to be ejected is the one easily deteriorated by heat or even when the liquid is the one with which the bubble generated is not sufficient, the liquid is desired to be ejected in good order without property change.

Japanese Laid-Open Patent Application No. SHO-61-69467, Japanese Laid-Open Patent Application No. SHO-55-81172 and U.S. Pat. No. 4,480,259 disclose that different liquids are used for the liquid generating the bubble by the heat (bubble generating liquid) and for the liquid to be ejected (ejection liquid). In these publications, the ink as the ejection liquid and the bubble generation liquid are completely separated by a flexible film of silicon rubber or the like so as to prevent direct contact of the ejection liquid to the heat generating element while propagating the pressure resulting from the bubble generation of the bubble generation liquid to the ejection liquid by the deformation of the flexible film. The prevention of the deposition of the material on the surface of the heat generating element and the increase of the selection latitude of the ejection liquid are accomplished, by such a structure.

However, with this structure in which the ejection liquid and the bubble generation liquid are completely separated, the pressure by the bubble generation is propagated to the ejection liquid through the expansion-contraction deformation of the flexible film, and therefore, the pressure is absorbed by the flexible film to quite a high degree. In addition, the deformation of the flexible film is not so large, and therefore, the energy use efficiency and the ejection force are deteriorated although the some effect is provided by the provision between the ejection liquid and the bubble generation liquid.

Inn many cases in the recording device using such a bubble jet recording system, a head cartridge which is detachable mountably relative to a carriage on the recording device and which integrally has an ink accommodating portion (ink container) and a head, is widely used.

This is because if the ink accommodating portion is placed at a different position on the carriage, it has to be connected with the recording head by a tube or like with the result of bulky apparatus or the possibility of evaporation of the ink in the connecting path.

In such a cartridge, the connecting portion with the recording means is in many cases provided below the center of the ink accommodating portion to increase the usage efficiency of the ink accommodated in the ink accommodating portion. In order to stably maintain the ink and to prevent ink leakage from the ejection portion such as a nozzle in the recording means, the ink accommodating portion in the head cartridge is given a function of generating a back pressure against the ink flow to the recording means. The back pressure is called "negative pressure", since it provides negative pressure relative to the ambient pressure at the ejection outlet portion.

In order to produce the negative pressure, the use may be made with capillary force of a porous material or member. The ink container using the method, comprises a porous material such as a sponge contained and preferably compressed in the entirety of the ink container, and an air vent for introducing air thereinto to facilitate the ink supply during the printing.

However, when the porous material is used as an ink retaining member, the ink accommodation efficiency per unit volume is low. In order to provide a solution to this problem, the porous material is contained in only a part of the ink container rather than in the entirety of the ink container. With such a structure, the ink accommodation efficiency and ink retaining performance per unit volume is larger than the structure having the porous material in the entirety of the ink container.

From the standpoint of improving the accommodation efficiency for the ink, there have been proposed a container accommodating a sponge as a source for negative pressure production, a bladder-like ink accommodating portion provided with a spring which is against the inward deformation thereof due to consumption of the ink to provide the negative pressure (Japanese Laid-Open Patent Application No. SHO-56-67269, Japanese Laid-Open Patent Application No. HEI-6-226993, for example). U.S. Pat. No. 4,509,062 discloses an ink accommodation portion of rubber having a conical configuration with a rounded top having a smaller thickness than the other portion. The round thinner portion of the circular cone portion provides a portion which displaces a deforms earlier than the other portion. These examples have been put into practice, and are satisfactory at present.

With the wider use of the ink jet technique, it is desired that large amounts of ink can be accommodated in a limited space so that exchange of the head cartridge is less frequent. This is because the head cartridge is detachably carried on a carriage which scanningly moves in an ink jet recording apparatus, and therefore, the size thereof is more or less limited.

When a conventional head is left for a long term, ejection failure may result, and if so, refreshing a process such as preliminary ejection or suction recovery has to be performed. As a result, the exchange of the cartridge is more frequent due to the loss of ink resulting from the refreshing process.

The porous member used in a conventional ink accommodating portion results in low ink accommodation efficiency per unit value, and therefore, in order to reduce the frequency of exchange of the cartridge, the size of the ink accommodating portion and therefore the size of the absorbing material are required to increase.

In some of the bladder-like container, a complicated mechanism using spring or the like is used; and in the case of ink accommodation member of the conical configuration rubber, the limitation to its structure is severe so that maximum accommodating portion is not accomplished in a limited space.

In addition, such an ink accommodation bladder is complicated in the structure and the manufacturing condition, so that quality control management is also complicated with the result of lower yield of manufacturing.

SUMMARY OF THE INVENTION

Accordingly, it is a principal object of the present invention to provide a head cartridge which has high ink accommodation efficiency.

According to an aspect of the present invention, there is provided a liquid ejecting head cartridge comprising: a liquid ejecting head comprising an ejection outlet for ejecting the liquid; a bubble generation region for generating the bubble in the liquid; a movable member disposed faced to the bubble generation region and displaceable between a first position and a second position further from the bubble generation region than the first position; wherein the movable member moves from the first position to the second position by pressure produced by the generation of the bubble to permit expansion of the bubble more in a downstream side closer to the ejection outlet than in an upstream side; and a liquid container, comprising: a substantially prism-like outer wall provided with a substantial air vent portion and having a corner formed by 3 surfaces; an inner wall having outer surfaces equivalent or similar to inside surfaces of the outer wall and a corner corresponding the corner of the outer wall, the inner wall being separable from the outer wall and defining a liquid accommodating portion for containing liquid to be supplied to the liquid ejection head therein, the inner wall further having a liquid supply portion for supplying the liquid out of the liquid accommodating portion to the liquid ejection head; wherein the inner wall has a thickness which is smaller in the corner portion than a central portion of the surfaces of the prism-like shape.

According to another aspect of the present invention, there is provided a liquid ejecting head cartridge comprising: a liquid ejecting head comprising: a heat generating element for generating the bubble in the liquid by applying heat to the liquid; a liquid flow path having a supply passage for supplying the liquid to the heat generating element from upstream thereof; and a movable member disposed faced to the heat generating element and having a free end adjacent the ejection outlet, the free end of the movable member being moved by pressure produced by the generation of the bubble to guide the pressure toward the ejection outlet; and a liquid container, comprising: a substantially prism-like outer wall provided with a substantial air vent portion and having a corner formed by 3 surfaces; an inner wall having outer surfaces equivalent or similar to inside surfaces of the outer wall and a corner corresponding the corner of the outer wall, the inner wall being separable from the outer wall and defining a liquid accommodating portion for containing liquid to be supplied to the liquid ejection head therein, the inner wall further having a liquid supply portion for supplying the liquid out of the liquid accommodating portion to the liquid ejection head; wherein with consumption of the liquid out the liquid accommodating portion, a central portion of a maximum area side of the inner wall deforms, and a corner portion corresponding to the maximum area side separates from a corresponding corner portion of the outer wall while maintaining a shape of corner.

According to a further aspect of the present invention, there is provided a liquid ejecting head cartridge comprising:

a liquid ejecting head comprising: a heat generating element for generating the bubble in the liquid by applying heat to the liquid; a liquid flow path having a supply passage for supplying the liquid to the heat generating element from upstream thereof; a movable member disposed faced to the heat generating element and having a free end adjacent the ejection outlet, the free end of the movable member being moved by pressure produced by the generation of the bubble to guide the pressure toward the ejection outlet; and a liquid passage for supplying the liquid to the heat generating element from upstream along such a side of the movable member as is closer to the heat generating element; and a liquid container, comprising: a substantially prism-like outer wall provided with a substantial air vent portion and having a corner formed by 3 surfaces; an inner wall having outer surfaces equivalent or similar to inside surfaces of the outer wall and a corner corresponding the corner of the outer wall, the inner wall being separable from the outer wall and defining a liquid accommodating portion for containing liquid to be supplied to the liquid ejection head therein, the inner wall further having a liquid supply portion for supplying the liquid out of the liquid accommodating portion to the liquid ejection head; wherein each side of the outer wall is convex toward the liquid accommodating portion, and each side of the inner wall has a thickness which is smaller in the corner portion than a central portion of the surfaces of the prism-like shape.

According to a further aspect of the present invention, there is provided a liquid ejecting head cartridge comprising: a liquid ejecting head comprising: a first liquid flow path in fluid communication with an ejection outlet; a second liquid flow path having bubble generation region for generating the bubble in the liquid by applying heat to the liquid; a movable member disposed between the first liquid flow path and the bubble generation region and having a free end adjacent the ejection outlet, wherein the free end of the movable member is displaced into the first liquid flow path by pressure produced by the generation of the bubble, thus guiding the pressure toward the ejection outlet of the first liquid flow path by the movement of the movable member to eject the liquid; and a liquid container, comprising a substantially liquid accommodating member having a corner formed by 3 surfaces; a corner enclosing member for constraining movement of the corner of the liquid accommodating member while permitting movement thereof without substantial deformation of the corner, the corner enclosing member can maintain its shape against deformation of the liquid accommodating member; a liquid supply port for supplying the liquid out of the liquid accommodating member; wherein the liquid supply member has a thickness which is smaller at the corner than that at a central portion of the surfaces of the prism-like shape.

According to a further aspect of the present invention, there is provided a liquid ejecting head cartridge comprising: a liquid ejecting head comprising: a grooved member integrally having a plurality of ejection outlets for ejecting the liquid, a plurality of grooves for forming a plurality of first liquid flow paths in direct fluid communication with the ejection outlets, and a recess for forming a first common liquid chamber for supplying the liquid to the first liquid flow paths; an element substrate having a plurality of heat generating elements for generating the bubble in the liquid by applying heat to the liquid; and a partition wall disposed between the grooved member and the element substrate and forming a part of walls of second liquid flow paths corresponding to the heat generating elements, and a movable member movable into the first liquid flow paths by pressure produced by the generation of the bubble, the movable member being faced to the heat generating element; and a liquid container, comprising: a substantially prism-like outer wall provided with a substantial air vent portion and having a corner formed by 3 surfaces; an inner wall having outer surfaces equivalent or similar to inside surfaces of the outer wall and a corner corresponding the corner of the outer wall, the inner wall being separable from the outer wall and defining a liquid accommodating portion for containing liquid to be supplied to first and second liquid passages of the liquid ejection head therein, the inner wall further having a liquid supply portion for supplying the liquid out of the liquid accommodating portion to the liquid ejection head; wherein the inner wall has a pinch-off portions sandwiched by the outer wall, wherein the inner wall has a thickness which is smaller in the corner portion than a central portion of the surfaces of the prism-like shape, and the pinch-off portions are provided in opposing sides.

According to a further aspect of the present invention, there is provided a liquid ejecting head cartridge comprising: a liquid ejecting head comprising: a grooved member integrally having a plurality of ejection outlets for ejecting the liquid, a plurality of grooves for forming a plurality of first liquid flow paths in direct fluid communication with the ejection outlets and a recess for forming a first common liquid chamber for supplying the liquid to the first liquid flow paths; an element substrate having a plurality of heat generating elements for generating the bubble in the liquid by applying heat to the liquid; and a partition wall disposed between the grooved member and the element substrate and forming a part of walls of second liquid flow paths corresponding to the heat generating elements, and a movable member movable into the first liquid flow paths by pressure produced by the generation of the bubble, the movable member being faced to the heat generating element; and a first liquid container for accommodating the liquid to be supplied to the first liquid passage; a second liquid container for accommodating the liquid to be supplied to the second liquid flow path; wherein the first liquid container, comprises a substantially prism-like outer wall provided with a substantial air vent portion and having a corner formed by 3 surfaces; an inner wall having outer surfaces equivalent or similar to inside surfaces of the outer wall and a corner corresponding the corner of the outer wall, the inner wall being separable from the outer wall and defining a liquid accommodating portion for containing liquid to be supplied to the liquid ejection head therein, the inner wall further having a liquid supply portion for supplying the liquid out of the liquid accommodating portion to the liquid ejection head; wherein the inner wall has a pinch-off portions sandwiched by the outer wall, wherein the inner wall has a thickness which is smaller in the corner portion than a central portion of the surfaces of the prism-like shape, and the pinch-off portions are provided in opposing sides.

According to a further aspect of the present invention, there is provided a liquid container for a liquid ejecting head the ejection head comprising an ejection outlet for ejecting the liquid; a bubble generation region for generating the bubble in the liquid; a movable member disposed faced to the bubble generation region and displaceable between a first position and a second position further from the bubble generation region than the first position; wherein the movable member moves from the first position to the second position be pressure produced by the generation of the bubble to permit expansion of the bubble more in a downstream side closer to the ejection outlet than in an upstream side; a corner portion constituted by extensions of three sides of the prism configuration; a liquid supply portion for supplying the liquid out; a casing covering at least a part of the liquid supply portion; wherein configuration of the corner is maintained until sides having the maximum areas are brought into contact to each other.

According to a further aspect of the present invention, there is provided a liquid container for a liquid ejecting head, the liquid ejection head comprising an ejection outlet for ejecting the liquid; a heat generating element for generating the bubble in the liquid by applying heat to the liquid; a liquid flow path having a supply passage for supplying the liquid to the heat generating element from upstream thereof; and a movable member disposed faced to the heat generating element and having a free end adjacent the ejection outlet, the free end of the movable member being moved by pressure produced by the generation of the bubble to guide the pressure toward the ejection outlet; a first liquid containing portion for accommodating the liquid to be supplied to the first liquid flow path; a second liquid containing portion for accommodating the liquid to be supplied to the second liquid flow path; wherein each of the first and liquid containers has a corner constituted by three surfaces of the prism configuration; a liquid supply portion for supplying the liquid out; an outer wall having an inner surface similar or equivalent to the outer surface of the liquid containing portion, and a corner portion corresponding to the corner portion of the liquid containing portion; wherein the outer wall of the first liquid containing portion and the outer wall of the second liquid containing portion are integral with each other.

According to a further aspect of the present invention, there is provided a liquid container for a liquid ejecting head, the liquid ejection head comprising a grooved member integrally having a plurality of ejection outlets for ejecting the liquid, a plurality of grooves for forming a plurality of first liquid flow paths in direct fluid communication with the ejection outlets, and a recess for forming a first common liquid chamber for supplying the liquid to the first liquid flow paths; an element substrate having a plurality of heat generating elements for generating the bubble in the liquid by applying heat to the liquid; and a partition wall disposed between the grooved member and the element substrate and forming a part of walls of second liquid flow paths corresponding to the heat generating elements, and a movable member movable into the first liquid flow paths by pressure produced by the generation of the bubble, the movable member being faced to the heat generating element; first and second accommodating portions for accommodating the liquid to be supplied to the first liquid passage and the liquid to be supplied to the second liquid flow path; each of the first and second liquid containers, comprising: a substantially prism-like outer wall provided with a substantial air vent portion and having a corner formed by 3 surfaces; an inner wall having outer surfaces equivalent or similar to inside surfaces of the outer wall and a corner corresponding the corner of the outer wall, the inner wall being separable from the outer wall and defining a liquid accommodating portion for containing liquid to be supplied to first and second liquid passages of the liquid ejection head therein, the inner wall further having a liquid supply portion for supplying the liquid out of the liquid accommodating portion to the liquid ejection head; wherein the inner wall has a pinch-off portions sandwiched by the outer wall, wherein the inner wall has a thickness which is smaller in the corner portion than a central portion of the surfaces of the prism-like shape; wherein liquid supply pressures the liquid supplied from the first liquid containing portion to the first liquid flow path and the liquid supplied from the second accommodating portion to the second liquid flow path are different.

According to a further aspect of the present invention, there is provided a liquid container for a liquid ejecting head, the liquid ejection head comprising a grooved member integrally having a plurality of ejection outlets for ejecting the liquid, a plurality of grooves for forming a plurality of first liquid flow paths in direct fluid communication with the ejection outlets, and a recess for forming a first common liquid chamber for supplying the liquid to the first liquid flow paths; an element substrate having a plurality of heat generating elements for generating the bubble in the liquid by applying heat to the liquid; and a partition wall disposed between the grooved member and the element substrate and forming a part of walls of second liquid flow paths corresponding to the heat generating elements, and a movable member movable into the first liquid flow paths by pressure produced by the generation of the bubble, the movable member being faced to the heat generating element; a first accommodating portion for accommodating the liquid to be supplied to the first liquid flow path; a second accommodating portion for accommodating the liquid to be supplied to the second liquid flow path; a casing covering at least a part of the first and second accommodating portion; wherein the first and second accommodating portions are each in the form of a prism configuration, and each has a corner constituted by three sides thereof, and a liquid supply portion for supplying the liquid to the liquid ejecting head, and wherein configuration of the corner is maintained until sides having the maximum areas are brought into contact to each other; wherein liquid supply pressures the liquid supplied from the first liquid containing portion to the first liquid flow path and the liquid supplied from the second accommodating portion to the second liquid flow path are different.

According to an aspect of the present invention, the ink can be efficiently accommodated in a limited space with the new ejection principle and the new negative pressure production type.

According to another aspect of the present invention, the ejection efficiency is improved by the synergistic effect of the bubble and the movable member so that liquid adjacent the ejection outlet can be efficiently ejected. For example, in the most desirable type of the present invention, the ejection efficiency is increased even to twice the conventional one.

The ejection failure can be avoided even after long term non-use under low temperature and low humidity conditions, and even if the ejection failure occurs, the normal state is restored by small scale refreshing process such as preliminary ejection or suction recovery.

According to the present invention, the time required for the recovery can be reduced, and the loss of the liquid by the recovery operation is reduced, so that running cost can be reduced.

In an aspect of improving the refilling property, the responsivity, the stabilized growth of the bubble and stabilization of the liquid droplet during the continuous ejections are accomplished, thus permitting high speed recording.

These and other objects, features and advantages of the present invention will become more apparent upon a consideration of the following description of the preferred embodiments of the present invention taken in conjunction with the accompanying drawings.

In this specification, "liquid supply pressure" is a negative pressure or static head or the like in the liquid containing portion.

In this specification, "internal pressure of the liquid flow path", is the pressure in the liquid flow path adjacent the movable member, and the "pressure difference" is a difference between the pressures in the first liquid path and the second liquid path.

In this specification, "upstream" and "downstream" are defined with respect to a general liquid flow from a liquid supply source to the ejection outlet through the bubble generation region (movable member).

As regards the bubble per se, the "downstream" is defined as toward the ejection outlet side of the bubble which directly function to eject the liquid droplet. More particularly, it generally means a downstream from the center of the bubble with respect to the direction of the general liquid flow, or a downstream from the center of the area of the heat generating element with respect to the same.

In this specification, "substantially sealed" generally means a sealed state in such a degree that when the bubble grows, the bubble does not escape through a gap (slit) around the movable member before motion of the movable member.

In this specification, "separation wall" may mean a wall (which may include the movable member) interposed to separate the region in direct fluid communication with the ejection outlet from the bubble generation region, and more specifically means a wall separating the flow path including the bubble generation region from the liquid flow path in direct fluid communication with the ejection outlet, thus preventing mixture of the liquids in the liquid flow paths.

DESCRIPTION OF THE PREFERRED EMBODIMENTS

(First Embodiment)

Figure 1A:
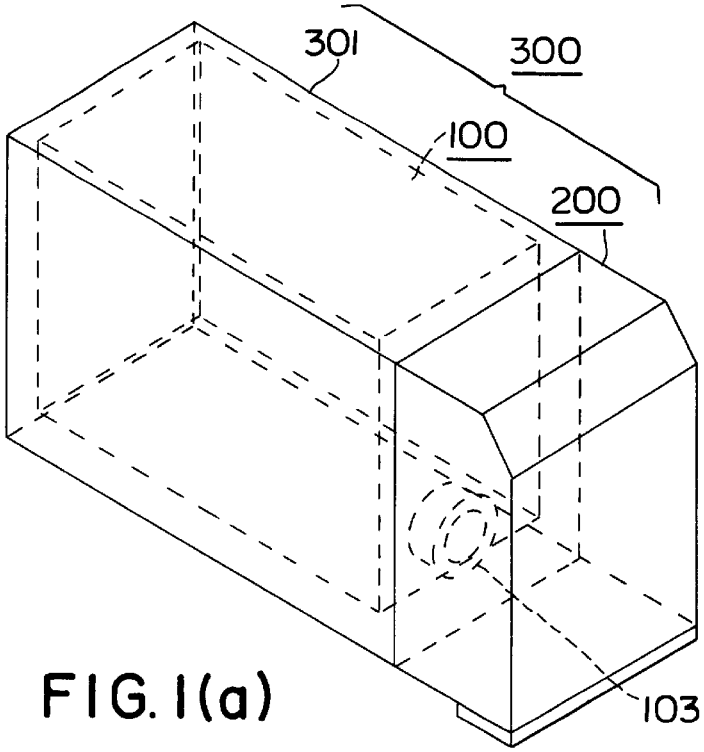
FIGS. 1(*a*) to 1(*c*) are schematic illustrations of a device according to a first embodiment of the present invention.
Figure 1B:
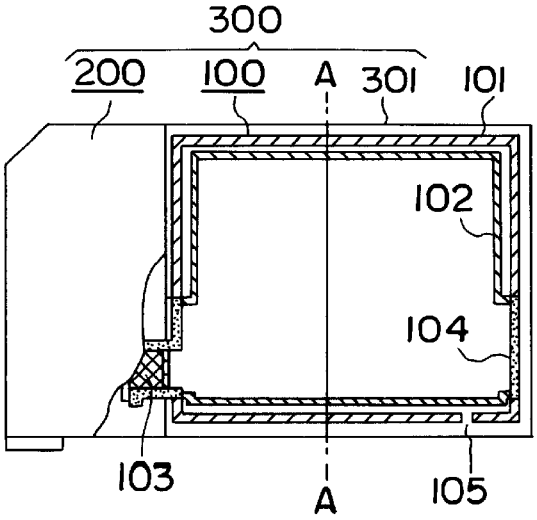
Figure 1C:
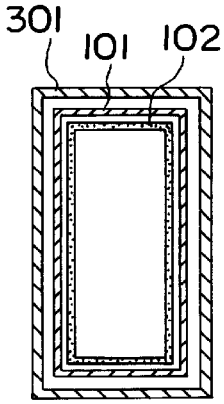
Figure 2A:
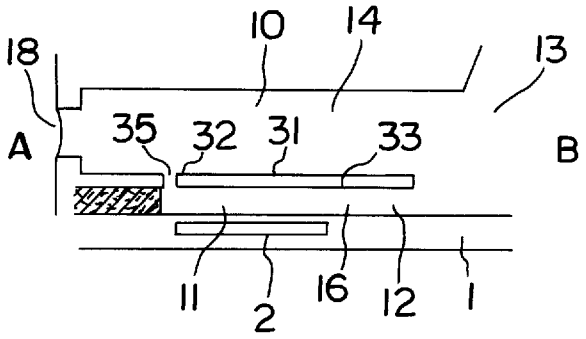
FIGS. 2(*a*) to 2(*d*) are schematic sectional views of a liquid ejecting head according to a first embodiment of the present invention.
Figure 2B:
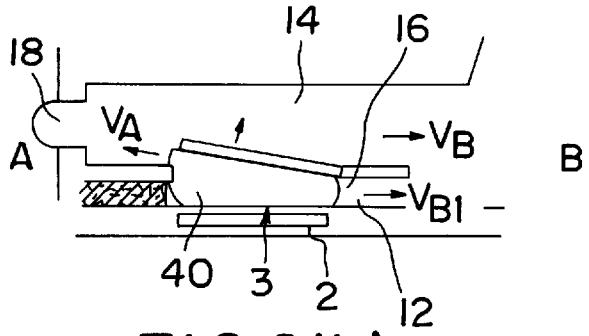
Figure 2C:
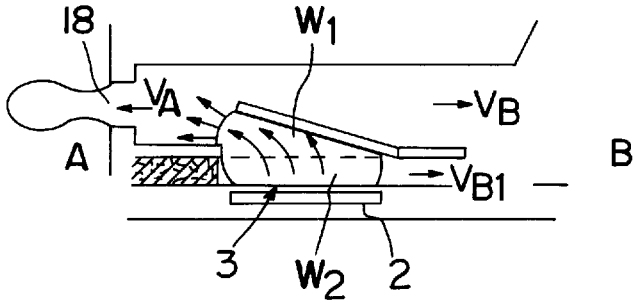
Figure 2D:
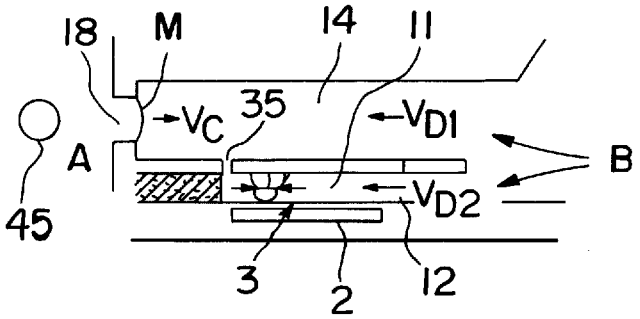

FIG. 1(*a*) to (*c*) shows a structure of a liquid ejection head cartridge in a device according to a first embodiment of the present invention, wherein (*a*) is a perspective view thereof, (*b*) is a sectional side view, (*c*) is a sectional view taken along a line A—A.

The ejection head cartridge 300 generally comprises a liquid ejecting head 200 including a plurality of liquid ejecting heads and a liquid container 100. In this embodiment, the liquid container 100 is covered with a casing 301, but an outer wall 101 of a liquid container which will be described hereinafter may also function as the casing 301.

The liquid ejecting head portion 200 comprises an element substrate, a separation wall, a grooved member, a confining spring, liquid supply member and a supporting member, which are not shown. The element substrate 1 is provided with an array of heat generating resistors for applying heat to bubble generation liquid which will be described hereinafter, and with a plurality of function elements for selectively driving the heat generating resistors. Between the element substrate and the separation wall having the movable wall, a bubble generating path which will be described hereinafter is formed, and by combining the separation wall and the grooved top plate, ejection flow paths for the liquid to be ejected are formed (unshown).

The confining spring functions to urge the grooved member to the element substrate, and is effective to properly integrate the element substrate, separation wall, grooved and the supporting member which will be described hereinafter.

Supporting member 70 functions to support an element substrate 1 or the like, and the supporting member 70 has thereon a circuit board 71, connected to the element substrate 1, for supplying the electric signal thereto, and contact pads 72 for electric signal transfer between the device side when the cartridge is mounted on the apparatus.

A liquid container 100, as shown in FIG. 1, (*b*), contains the liquid to be ejected in the region (liquid containing portion) enclosed by the inner wall 102 separable from an outer wall 101 adjacent to the casing. The outer wall 101 is sufficiently thicker than the inner wall such that it hardly deforms even if the inner wall 102 deforms due to the discharge of the liquid. The outer wall has an air vent 105 to permit introduction of the air through an air vent (not shown) formed in the casing 301. The inner wall has a welded portion (pinch-off portion) 104, by which the inner wall is connected with the outer wall.

The liquid container 100 and the liquid ejecting head 200 are in fluid communication with each other through a liquid discharging outlet (liquid supply portion) 103 formed in the liquid container 100, and are made integral with each other by unshown positioning means and fixing means. The ejection liquid is supplied from the liquid containing portion of the liquid container through the liquid discharging outlet 103 to the liquid supply path of the liquid supply member of the liquid ejecting head side, and is supplied from the common liquid chamber to the ejection flow path and the bubble generation liquid path of the ejection heads.

The description will be made as to liquid ejecting head and liquid container in this embodiment, particularly as to the operation principle.

Liquid Ejecting Head

The liquid ejecting head will be described in detail, in conjunction with the drawings. In the liquid ejecting head of the present invention, the ejection power or the ejection efficiency are improved by controlling the pressure propagating direction and/or the bubble growing direction.

Figure 3:
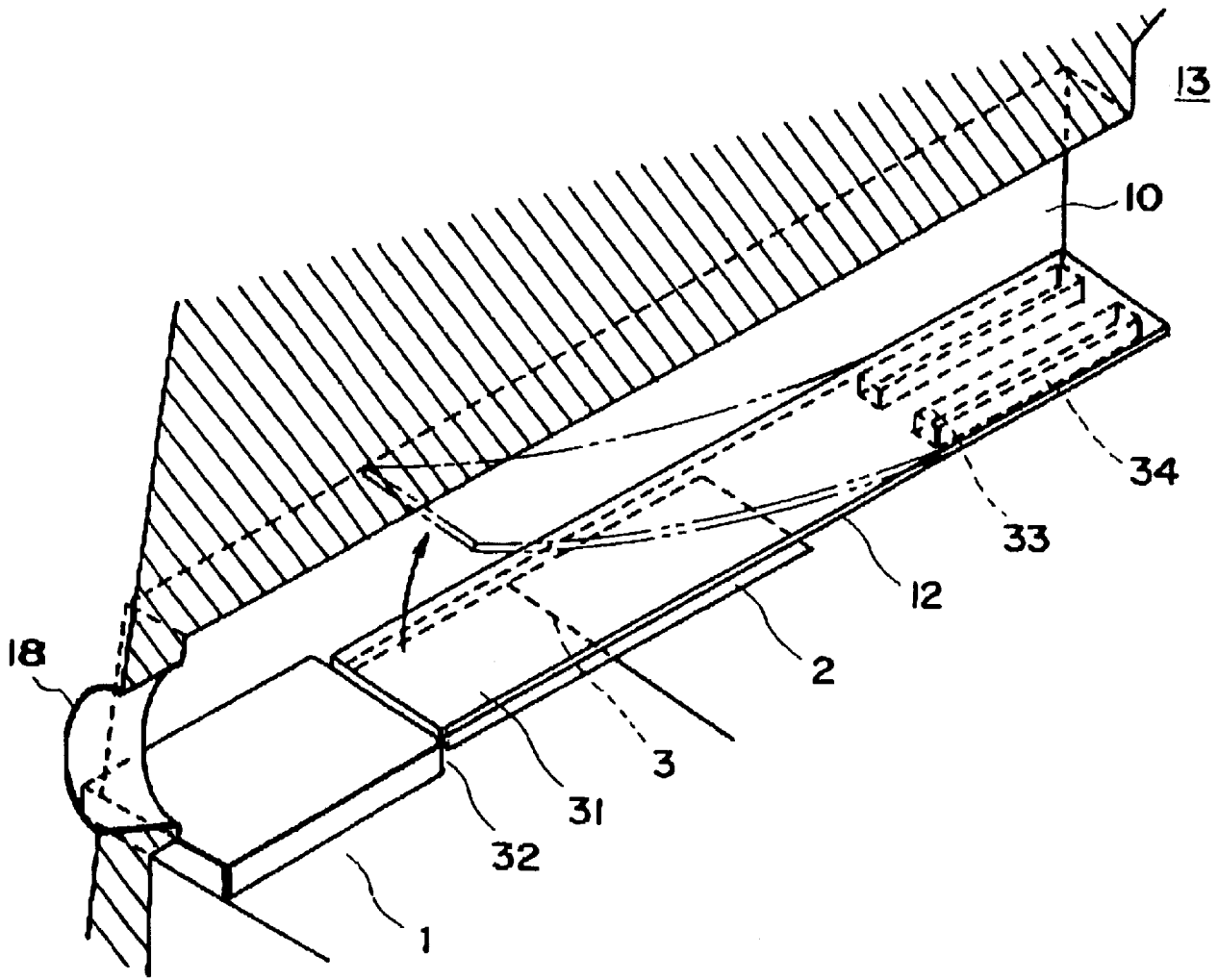
FIG. 3 is a partial sectional view of a liquid ejecting head according to the first embodiment.

FIG. 2 is a schematic sectional view of a liquid ejecting head taken along a liquid flow path according to this embodiment, and FIG. 3 is a partly broken perspective view of the liquid ejecting head.

The liquid ejecting head of this embodiment comprises a heat generating element 2 ( a heat generating resistor of 40 $\mu$m×105 $\mu$m in this embodiment) as the ejection energy generating element for supplying thermal energy to the liquid to eject the liquid, an element substrate 1 on which said heat generating element 2 is provided, and a liquid flow path 10 formed above the element substrate correspondingly to the heat generating element 2. The liquid flow path 10 is in fluid communication with a common liquid chamber 13 for supplying the liquid to a plurality of such liquid flow paths 10 which is in fluid communication with a plurality of the ejection outlets 18, respectively.

Above the element substrate in the liquid flow path 10, a movable member or plate 31 in the form of a cantilever of an elastic material such as metal is provided faced to the heat generating element 2. One end of the movable member is fixed to a foundation (supporting member) or the like provided by patterning of photosensitivity resin material on the wall of the liquid flow path 10 or the element substrate. By this structure, the movable member is supported, and a fulcrum (fulcrum portion ) 33 is constituted.

The movable member 31 is so positioned that it has a fulcrum (fulcrum portion which is a fixed end) 33 in an upstream side with respect to a general flow of the liquid from the common liquid chamber 13 toward the ejection outlet 18 through the movable member 31 caused by the ejecting operation and so that it has a free end (free end portion) 32 in a downstream side of the fulcrum 33. The movable member 31 is faced to the heat generating element 2 with a gap of 15 $\mu$m approx. as if it covers the heat generating element 2. A bubble generation region is constituted between the heat generating element and movable member. The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow path 10 is divided by the movable member 31 into a first liquid flow path 14 which is directly in communication with the ejection outlet 18 and a second liquid flow path 16 having the bubble generation region 11 and the liquid supply port 12.

By causing heat generation of the heat generating element 2, the heat is applied to the liquid in the bubble generation region 11 between the movable member 31 and the heat generating element 2, by which a bubble is generated by the film boiling phenomenon as disclosed in U.S. Pat. No. 4,723,129. The bubble and the pressure caused by the generation of the bubble act mainly on the movable member, so that movable member 31 moves or displaces to widely open toward the ejection outlet side about the fulcrum 33, as shown in FIG. 2(*b*),(*c*) or FIG. 3. By the displacement of the movable member 31 or the state after the displacement, the propagation of the pressure caused by the generation of the bubble and the growth of the bubble per se are directed toward the ejection outlet.

Here, one of the fundamental ejection principles according to the present invention will be described. One of important principles of this invention is that movable member disposed faced to the bubble is displaced from the normal first position to the displaced second position on the basis of the pressure of the bubble generation or the bubble per se, and the displacing or displaced movable member 31 is effective to direct the pressure produced by the generation of the bubble and/or growth of the bubble per se toward the ejection outlet 18 (downstream).

Figure 4:
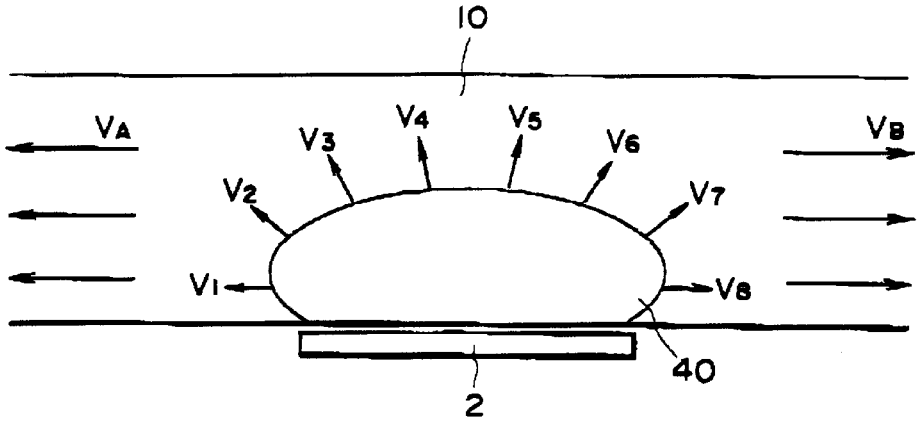
FIG. 4 is a schematic view showing pressure propagation from a bubble in a conventional head.
Figure 5:
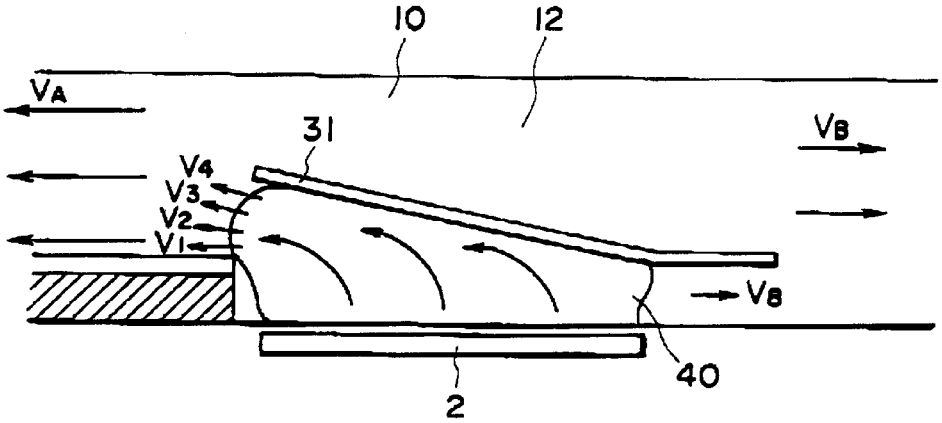
FIG. 5 is a schematic view illustrating pressure propagation from a bubble in a head in a head cartridge of an embodiment of the present invention.

More detailed description will be made with comparison between the conventional liquid flow passage structure not using the movable member (FIG. 4) and the present invention (FIG. 5). Here, the direction of propagation of the pressure toward the ejection outlet is indicated by $V_A$, and the direction of propagation of the pressure toward the upstream is indicated by $V_B$.

In a conventional head as shown in FIG. 4, there is not any structural element effective to regulate the direction of the propagation of the pressure produced by the bubble generation 40. Therefore, the direction of the pressure propagation is normal to the surface of the bubble as indicated by V1–V8, and therefore, is widely directed in the passage. Among these directions, those of the pressure propagation from substantially the half portion of the bubble closer to the ejection outlet (V1–V4), have the pressure components in the $V_A$ direction which is most effective for the liquid ejection. This portion is important since it is directly contributable to the liquid ejection efficiency, the liquid ejection pressure and the ejection speed. Furthermore, the component V1 is closest to the direction of $V_A$ which is the ejection direction, and therefore, the component is most effective, and the V4 has a relatively small component in the direction $V_A$.

On the other hand, in the case of the present invention, shown in FIG. 5, the movable member 31 is effective to direct, to the downstream (ejection outlet side), the pressure propagation directions V1–V4 of the bubble which otherwise are toward various directions. Thus, the pressure propagations of bubble 40 are concentrated so that pressure of the bubble 40 is directly and efficiently contributable to the ejection. The growth direction per se of the bubble is directed downstream similarly to the pressure propagation directions V1–V4, and the bubble grows more in the downstream side than in the upstream side. Thus, the growth direction per se of the bubble is controlled by the movable member, and the pressure propagation direction from the bubble is controlled thereby, so that ejection efficiency, ejection force and ejection speed or the like are fundamentally improved.

Referring back to FIG. 2, the ejecting operation of the liquid ejecting head of this embodiment will be described.

FIG. 2(*a*) shows a state before the energy such as electric energy is applied to the heat generating element 2, and therefore, no heat has yet been generated. It should be noted that movable member 31 is so positioned as to be faced at least to the downstream portion of the bubble generated by the heat generation of the heat generating element. In other words, in order that downstream portion of the bubble acts on the movable member, the liquid flow passage structure is such that movable member 31 extends at least to the position downstream (downstream of a line passing through the center 3 of the area of the heat generating element and perpendicular to the length of the flow path) of the center 3 of the area of the heat generating element.

FIG. 2(*b*) shows a state wherein the heat generation of heat generating element 2 occurs by the application of the electric energy to the heat generating element 2, and a part of the liquid filled in the bubble generation region 11 is heated by the thus generated heat so that bubble is generated as a result of film boiling.

At this time, the movable member 31 is displaced from the first position to the second position by the pressure produced by the generation of the bubble 40 so as to guide the propagation of the pressure toward the ejection outlet. It should be noted that, as described hereinbefore, the free end 32 of the movable member 31 is disposed in the downstream side (ejection outlet side), and the fulcrum 33 is disposed in the upstream side (common liquid chamber side), so that at least a part of the movable member is faced to the downstream portion of the bubble, that is, the downstream portion of the heat generating element.

FIG. 2(*c*) shows a state in which the bubble 40 has further grown by the pressure resulting from the bubble 40 generation, the movable member 31 is displaced further. The generated bubble grows more downstream than upstream, and it expands greatly beyond a first position (broken line position) of the movable member. Thus, it is understood that in accordance with the growth of the bubble 40, the movable member 31 gradually displaces, by which the pressure propagation direction of the bubble 40, the direction in which the volume movement is easy, namely, the growth direction of the bubble, are directed uniformly toward the ejection outlet, so that ejection efficiency is increased. When the movable member guides the bubble and the bubble generation pressure toward the ejection outlet, it hardly obstructs propagation and growth, and can efficiently control the propagation direction of the pressure and the growth direction of the bubble in accordance with the degree of the pressure.

FIG. 2(*d*) shows the bubble 40 contracting and extinguishing by the decrease of the internal pressure of the bubble after the film boiling.

The movable member 31 having been displaced to the second position returns to the initial position (first position) of FIG. 2(*a*) by the restoring force provided by the spring property of the movable member per se and the negative pressure due to the contraction of the bubble. Upon the collapse of bubble, the liquid flows back from the common liquid chamber side as indicated by $V_{D1}$ and $V_{D2}$ and from the ejection outlet side as indicated by $V_c$ so as to compensate for the volume reduction of the bubble in the bubble generation region 11 and to compensate for the volume of the ejected liquid.

In the foregoing, the description has been made as to the operation of the movable member 31 with the generation of the bubble and the ejecting operation of the liquid. Now, the description will be made as to the refilling of the liquid in the liquid ejecting head of the present invention.

Referring to FIG. 2, the liquid supply mechanism will be described.

After the sated shown in FIG. 2(*c*), when the bubble 40 enters the bubble collapsing process after the maximum volume thereof, a volume of the liquid enough to compensate for the collapsing bubbling volume flows into the bubble generation region from the ejection outlet 18 side of the first liquid flow path 14 and from the common liquid chamber side 13 of the second liquid flow path 16. In the case of conventional liquid flow passage structure not having the movable member 31, the amount of the liquid from the ejection outlet side to the bubble collapse position and the amount of the liquid from the common liquid chamber thereinto, correspond to the flow resistances of the portion closer to the ejection outlet than the bubble generation region and the portion closer to the common liquid chamber (flow path resistances and the inertia of the liquid).

Therefore, when the flow resistance at the ejection outlet side is small, a large amount of the liquid flows into the bubble collapse position from the ejection outlet side, with the result that meniscus retraction is large. With the reduction of the flow resistance in the ejection outlet for the purpose of increasing the ejection efficiency, the meniscus retraction increases upon the collapse of bubble with the result of longer refilling time period, thus making high speed printing difficult.

According to this embodiment, because of the provision of the movable member 31, the meniscus retraction stops at the time when the movable member returns to the initial position upon the collapse of bubble, and thereafter, the supply of the liquid to fill a volume W2 is accomplished by the flow through the second flow path 16 (W1 is a volume of an upper side of the bubble volume W beyond the first position of the movable member 31, and W2 is a volume of a bubble generation region 11 side thereof). In the prior art, a half of the volume of the bubble volume W is the volume of the meniscus retraction, but according to this embodiment, only about one half (W1) is the volume of the meniscus retraction.

Additionally, the liquid supply for the volume W2 is forced to be effected mainly from the upstream of the second liquid flow path along the surface of the heat generating element side of the movable member 31 using the pressure upon the collapse of bubble, and therefore, more speedy refilling action is accomplished.

When the high speed refilling using the pressure upon the collapse of bubble is carried out in a conventional head, the vibration of the meniscus is expanded with the result of the deterioration of the image quality. However, according to this embodiment, the flows of the liquid in the first liquid flow path 14 at the ejection outlet side and the ejection outlet side of the bubble generation region 11 are suppressed, so that vibration of the meniscus is reduced.

Thus, according to this embodiment, the high speed refilling is accomplished by the forced refilling to the bubble generation region through the liquid supply passage 12 of the second flow path 16 and by the suppression of the meniscus retraction and vibration. Therefore, the stabilization of ejection and high speed repeated ejections are accomplished, and when the embodiment is used in the field of recording, the improvement in the image quality and in the recording speed can be accomplished.

The embodiment provides the following effective function, too. It is a suppression of the propagation of the pressure to the upstream side (back wave) produced by the generation of the bubble. The pressure due to the common liquid chamber 13 side (upstream) of the bubble generated on the heat generating element 2 mostly has resulted in force which pushes the liquid back to the upstream side (back wave). The back wave deteriorates the refilling of the liquid into the liquid flow path by the pressure at the upstream side, the resulting motion of the liquid and the inertia force. In this embodiment, these actions to the upstream side are suppressed by the movable member 31, so that refilling performance is further improved.

The description will be made as to a further characterizing feature and the advantageous effect.

The second liquid flow path 16 of this embodiment has a liquid supply passage 12 having an internal wall substantially flush with the heat generating element 2 (the surface of the heat generating element is not greatly stepped down) at the upstream side of the heat generating element 2. With this structure, the supply of the liquid to the surface of the heat generating element 2 and the bubble generation region 11 occurs along the surface of the movable member 31 at the position closer to the bubble generation region 11 as indicated by $V_{D2}$. Accordingly, stagnation of the liquid on the surface of the heat generating element 2 is suppressed, so that precipitation of the gas dissolved in the liquid is suppressed, and the residual bubbles not extinguished are removed without difficulty, and in addition, the heat accumulation in the liquid is not too much. Therefore, the stable bubble generation can be repeated at high frequency. In this embodiment, the liquid supply passage 12 has a substantially flat internal wall, but this is not limiting, and the liquid supply passage is satisfactory if it has an internal wall with such a configuration smoothly extended from the surface of the heat generating element that stagnation of the liquid occurs on the heat generating element, and eddy flow is not significantly caused in the supply of the liquid.

The supply of the liquid into the bubble generation region may occur through a gap at a side portion of the movable member (slit 35) as indicated by $V_{D1}$. In order to direct the pressure upon the bubble generation further effectively to the ejection outlet, a large movable member covering the entirety of the bubble generation region (covering the surface of the heat generating element) may be used, as shown in FIG. 2. Then, the flow resistance for the liquid between the bubble generation region 11 and the region of the first liquid flow path 14 close to the ejection outlet is increased by the restoration of the movable member to the first position, so that flow of the liquid to the bubble generation region 11 along $V_{D1}$ can be suppressed. However, according to the head structure of this embodiment, there is a flow effective to supply the liquid to the bubble generation region, the supply performance of the liquid is greatly increased, and therefore, even if the movable member 31 covers the bubble generation region 11 to improve the ejection efficiency, the supply performance of the liquid is not deteriorated.

Figure 8:
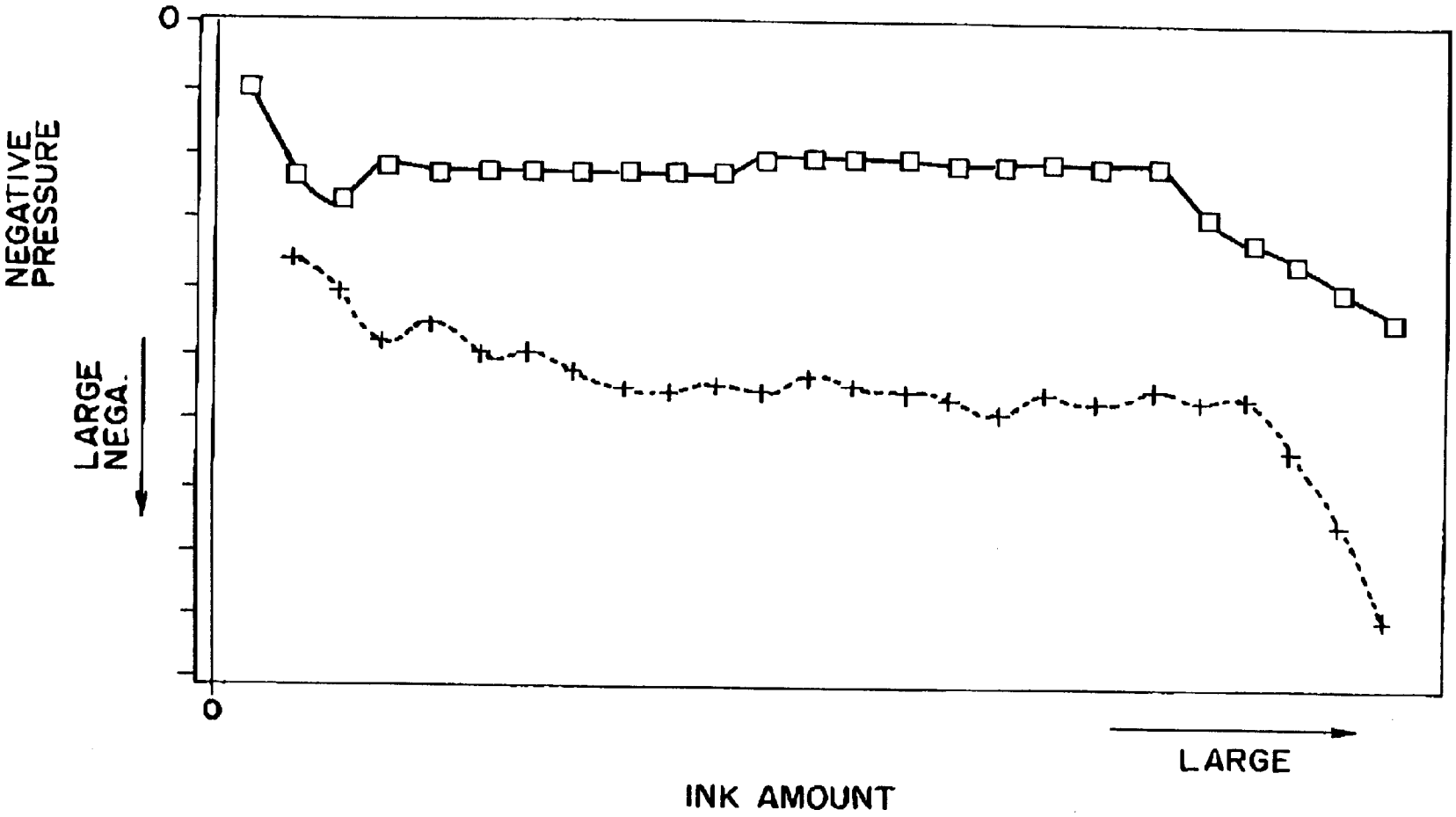
FIG. 8 is a schematic view showing a negative pressure property of a liquid container usable with the head cartridge according to an embodiment of the present invention.

The positional relation between the free end 32 and the fulcrum 33 of the movable member 31 is such that free end is at a downstream position of the fulcrum as shown in FIG. 2, for example. With this structure, the function and effect of guiding the pressure propagation direction and the direction of the growth of the bubble to the ejection outlet side or the like can be efficiently assured upon the bubble generation. Additionally, the positional relation is effective to accomplish not only the function or effect relating to the ejection but also the reduction of the flow resistance through the liquid flow path 10 upon the supply of the liquid thus permitting the high speed refilling. When the meniscus M retracted b the ejection as shown in FIG. 8, returns to the ejection outlet 18 by capillary force or when the liquid supply is effected to compensate for the collapse of bubble, the positions of the free end and the fulcrum 33 are such that flows $s_1$, $S_2$ and $S_3$ through the liquid flow path 10 including the first liquid flow path 14 and the second liquid flow path 16, are not impeded.

As has been described hereinbefore, in FIG. 2 showing the embodiment of the present invention, the movable member 31 is extended so that free end 32 thereof is faced to such a part of the heat generating element 2A as is downstream of an area center 3 between an upstream region thereof and a downstream region (a line passing through an area center of the heat generating element (center portion) and extending perpendicularly to the direction along the liquid flow path). The movable member 31 receives the pressure and the bubble which are greatly contributable to the ejection of the liquid at the downstream side of the area center position 3 of the heat generating element, and it guides the force to the ejection outlet side, thus fundamentally improving the ejection efficiency or the ejection force.

Further advantageous effects are provided using the upstream side of the bubble, as described hereinbefore.

Furthermore, it is considered that in the structure of this embodiment, the instantaneous mechanical movement of the free end of the movable member 31, contributes to the ejection of the liquid.

According to the liquid ejection head of this invention, synergistic effects of the generated bubble and the displacement of the movable member can be provided so that liquid adjacent the ejection outlet can be efficiently ejected, and therefore, the ejection efficiency can be improved over the conventional bubble jet type ejection head.

According to this invention, the ejection power is enhanced, and therefore, ejection failure can be avoided even after long term non-use under low temperature and low humidity conditions, and even if the ejection failure occurs, the normal state is restored by small scale refreshing process such as preliminary ejection or suction recovery. According to the present invention, the time required for the recovery can be reduced, and the loss of the liquid by the recovery operation is reduced, so that running cost can be reduced.

Liquid Container

Figure 6A:
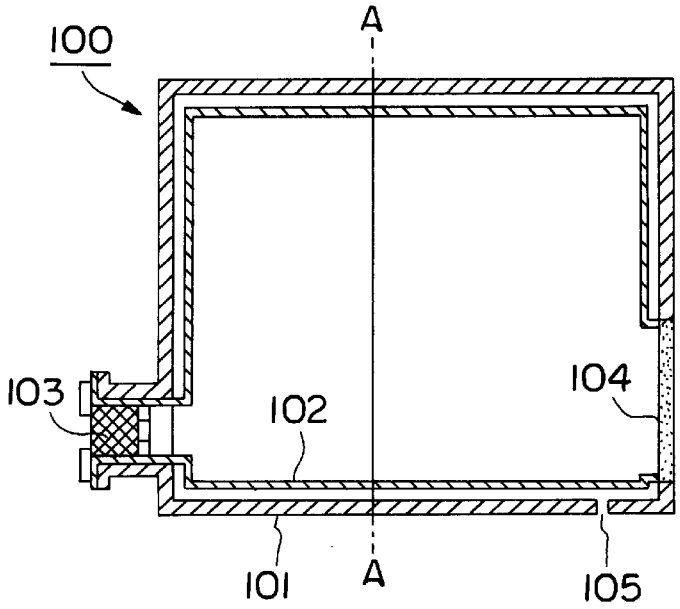
FIGS. 6(*a*) to 6(*c*) are schematic views of a liquid container according to the first embodiment of the present invention.
Figure 6B:
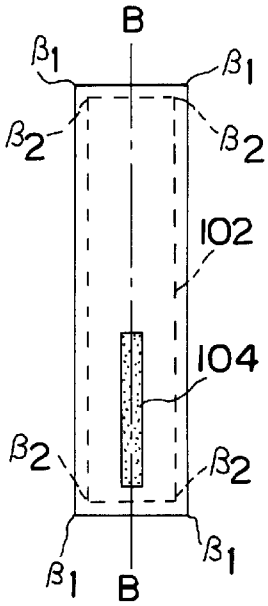
Figure 6C:
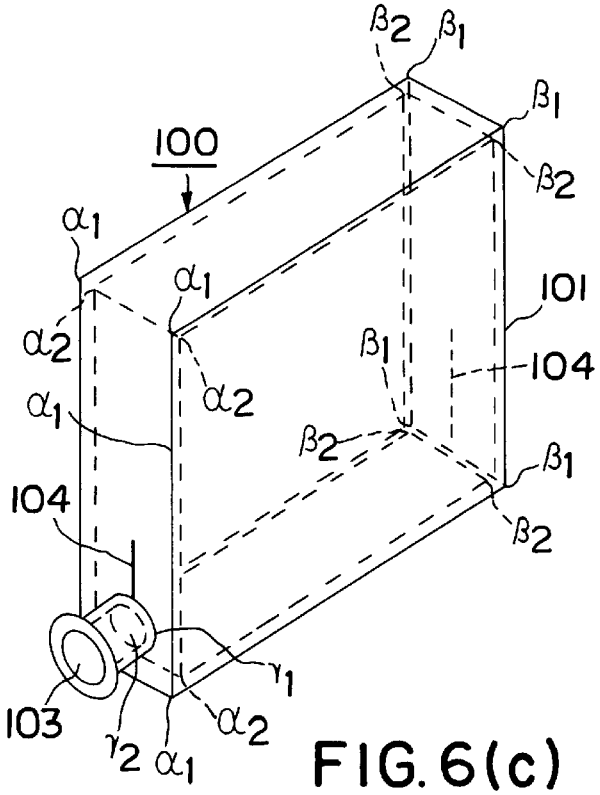
Figure 7:
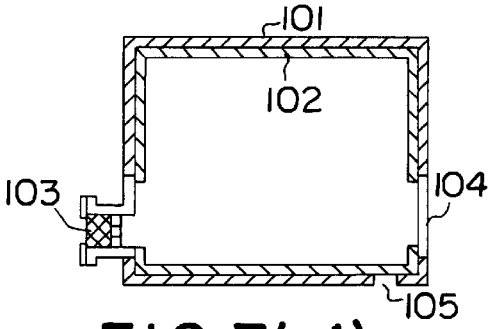
FIGS. 7(*a*1) to 7(*d*2) are schematic views illustrating deformation of the liquid container due to the discharge of the liquid in a head cartridge according to an embodiment of the present invention.
Figure 7:
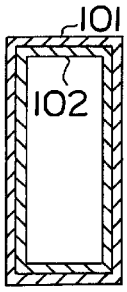
Figure 7:
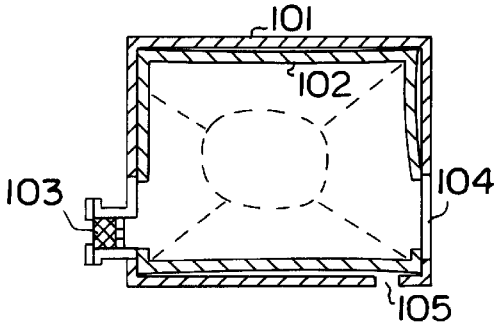
Figure 7:
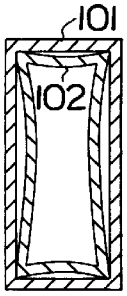
Figure 7:
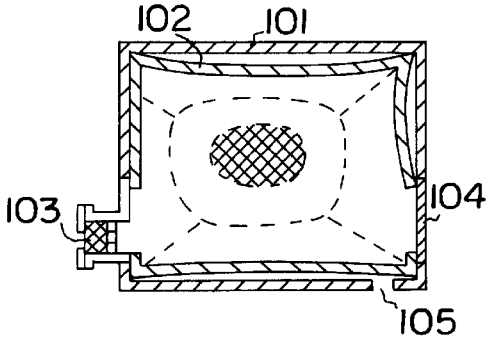
Figure 7:
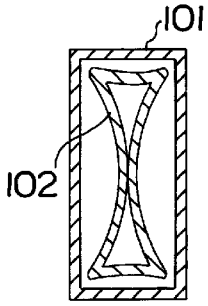
Figure 7:
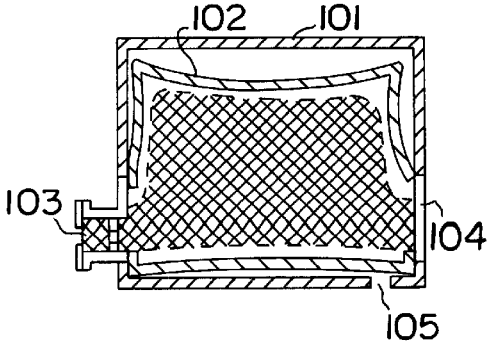
Figure 7:
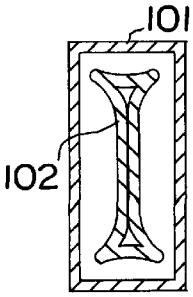

Referring to FIGS. 6, 7 and FIG. 8, the description will be made as to stabilized negative pressure production and maintenance in the liquid container used in the head cartridge.

FIG. 6, (*a*) to (*c*) is schematic views showing a structure of a liquid container according to an embodiment of the present invention, wherein (*a*) is a sectional view (*b*) is a side view, and (*c*) is a perspective view. As will been best seen in FIG. 6, (*c*), the maximum area side among the sides constituting the outer wall of the container of FIG. 1, is the surface shown in indirectly in the sectional view of FIG. 6, (*a*). FIG. 7 is an illustration of the liquid container when the liquid therein is consumed, wherein (*a*1)–(*d*1) are sectional views taken along a line B—B of FIG. 6, (*b*), and (*a*2)–(*d*2) are sectional vies taken along a line A—A of FIG. 1, (*a*). The liquid container of this embodiment has an inner wall (inner shell) and a outer wall (outer casing, housing or frame) and a separation layer, and the liquid container has been manufactured through a single process using a direct blow molding as will be described hereinafter.

The liquid container of this embodiment is such that at the initial state, the corner portions of the inner wall correspond to the corner portions of the outer wall, so that inner wall 102 has a similar shape to the outer wall 101, and the configuration of the inner wall 102 is extended along the outer wall 101 with a predetermined gap therebetween. Therefore, the dead space as seen in a bladder-like container contained in a casing as in prior art, can be removed, thus increasing the liquid containing amount per unit volume of the outer wall of the liquid container can be increased (increase of the liquid containing efficiency).

The liquid container 100 of FIG. 6 is constituted by 6 flat surfaces, and by an additional cylindrical liquid supplying portion 103. The maximum area surfaces of the inner and outer walls at the respective sides of the liquid supplying portion 103 have 6 corners ($\alpha$1, $\beta$1, $\beta$1 and $\alpha$1), and ($\alpha$2, $\beta$2, $\beta$2 and $\alpha$2), respectively, as will be described in detail hereinafter.

The thickness of the inner wall is smaller in the corner portions than in the central portions of the surfaces or sides constituting the substantially prism-like (more particularly, rectangular parallelepiped) configuration, more particularly, the thickness gradually decreases from the central portions of each side surface to the associated corners, and therefore, the respective surfaces are convex toward the inside of the liquid accommodating portion. The convex configuration is along the direction of deformation of the surface occurring with the consumption of the liquid. The convex shape promotes the deformation of the liquid accommodating portion.

The corner of the inner wall is provided by 3 surfaces, which will be described hereinafter, so that strength of the corner as a whole is relatively high as compared with the strength of the central portion of the surfaces. However, the surfaces at and adjacent each corner has a thickness smaller than the center portions of the surfaces providing the corner, thus permitting easy movement of the surfaces, as will be described hereinafter. It is desirable that portions constituting the inner wall corner have substantially the same thicknesses.

In FIGS. 6 and 7, the outer wall 101 and the inner wall 102 of the liquid container are separated with a relatively large clearance therebetween, but it is not inevitable, and the clearance may be so small that they may be substantially contacted, or it will suffice if they are separable, Therefore, in the initial state, the corners $\alpha$2, $\beta$2 of the inner wall 102 are at the inner side of the corners $\alpha$1, $\beta$1 of the outer wall 101 (FIG. 7, (*a*1) and (*a*2)).

Here, the corner means a crossing portion of at least 3 surfaces of polyhedron constituting the liquid container, and a portion corresponding to a crossing portion of extended surfaces thereof. The reference characters designating the corners are such that $\alpha$ means corners formed by the surfaces having the liquid supply port, and $\beta$ means the other corners; and suffix 1 is for the outer wall, and suffix 2 is for the inner wall. The crossing portions between the substantial flat surface and the curved surface of the cylindrical liquid supplying portion is designated by $\gamma$; and the outer wall and inner wall are formed at the crossing portions, too, which are designated by $\gamma$1 and $\gamma$2. The corner may be rounded in a small range. In such a case, the round portions are deemed as corners, and the other surface portions are deemed as side surfaces.

The liquid of the liquid accommodating portion is supplied out in response to the ejections of the liquid through the liquid jet recording head of the liquid jet recording means, in accordance with which the inner wall starts to deform in a direction of reducing the volume of the liquid accommodating portion, first at the central portion of the maximum area surface. The outer wall functions to constrain the displacement of the corners of the inner wall. In this embodiment, the corners $\alpha$2 , $\beta$2 are hardly moved, so that corners are effective to be against the deformation caused by the liquid consumption, and therefore, a stabilized negative pressure is produced.

The air is introduced through the air vent 105 into between the inner wall 102 and the outer wall 101, and the surfaces of the inner wall can be deformed smoothly, thus permitting the negative pressure to be stably maintained. Thus, the space formed between the inner wall and the outer wall, is in fluid communication with the ambience through the air vent 105. Then, the force provided by the inner wall and the meniscus force at the ejection outlet of the recording head balance so that liquid is retained (FIG. 7, (*b*1) and (*b*2)).

When quite a large amount of the liquid is discharged form the liquid accommodating portion (FIG. 7, (*c*1) and (*c*2)), the ink accommodating portion is deformed, more particularly, the central portions of the liquid accommodating portion smoothly deforms inwardly, as described hereinbefore. The welded portions 104 function to constrain the deformation of the inner wall. Therefore, as for the sides adjacent to the maximum area sides, the portions not having the pinch-off portion start to deform so as to become away from the outer wall earlier than the portions having the pinch-off portions 104.

However, only with these inner wall deformation constraining portions described above the deformation of the inner wall adjacent to the liquid supplying portion may close the ink supplying portion before the liquid contained in the liquid accommodating portion is used up to sufficient extent.

According to this embodiment, however, the corner $\alpha$2 of the inner wall shown in FIG. 6, (*c*), is adjacent along the corner $\alpha$1 of the outer wall in the initial state, and therefore when the inner wall is deformed, the corner of the inner wall is less easily deformed than the other portion of the inner wall, so that deformation of the inner wall is effectively constrained. In this embodiment, the angles of the corners $\alpha$2 are 90 degrees.

Here, the angle of the corner $\alpha$2 of the inner wall is defined as the corner $\alpha$1 between two substantially flat surfaces of the at least 3 surfaces of the outer wall, namely, as the portion of the crossing portion of the extensions of the 2 surfaces. The angle of the corner of the inner wall is defined as the angle of the corner of the outer wall, because in the manufacturing step which will be described hereinafter, the container is manufactured on the basis of the outer wall and because the inner wall and outer wall are similar in configuration in the initial state.

Thus, as will be understood form FIG. 7, (*c*1) and (*c*2), the corner α2 of the inner wall shown in FIG. 6, (*c*) is provided separably from the corresponding corner of the outer wall, and on the other hand, the corner α2 of the inner wall other than the corner formed by the surfaces having the ink supply port, is slightly separated from the corner α2 of the correspondence outer wall as compared with the corner α2. However, in the embodiment of FIG. 6 and 7, the angle β at the opposite position is generally not more than 90 degrees. Therefore, the positional relation relative to the outer wall can be maintained close to the initial state as compared with the other parts of the inner wall constituting the liquid accommodating portion, so as to provide an auxiliary support for the inner wall.

Furthermore, in FIG. 7, (*c*1) and (*c*2), the opposite maximum surface area sides are substantially simultaneously deformed, and therefore, the center portions thereof are brought into contact with each other. The contact portion of the center portions (FIG. 7, (*c*1) and (*d*1), hatched portion) expands with further ink discharge. In other words, in the liquid container of this embodiment, the opposite maximum area sides of the container start to contact before the edge formed between the maximum area side and the side adjacent to thereto, collapses, with the consumption of the liquid.

FIG. 7, (*d*1) and (*d*2) show the state in which substantially the entirely of the liquid is used up from the liquid accommodating portion (final state).

In this state, the contact portion of the ink accommodating portion, expands substantially over the entirely of the ink accommodating portion, and one or some of the corners β2 of the inner wall are completely separated form the corresponding corners β1 of the outer wall. On the other hand, the corner α2 of the inner wall is still separably positioned closely to the corresponding corner α1 of the outer wall even in the final state, so that corner functions to constrain the deformation to the end.

Before this state is reached, the welded portion 104 may have been separated from the outer wall, depending on the thickness of the inner wall. Even in that case, the length of the welded portion 104 is maintained, and therefore, the direction of the deformation is limited. Therefore, even when the welded portion is disengaged from the outer wall, the deformation is not irregular but is balanced.

As described in the foregoing, the deformation starts at the maximum area sides, which then are brought into surface contact with each other before an edge of the maximum are sides are collapsed, and the contact area increases. The corners other than the corners constituted by the side having the liquid supplying portion are permitted to move. Thus, the order of precedence of deforming portions of the ink accommodating portion is provided by the structure thereof.

At least one of the maximum area sides of the substantially flat sides of the outer wall of the liquid container having a substantially prism configuration, is not fixed to the inner, wall. This will be described in detail.

When the amount of the ink in the liquid accommodating portion reduces by the ejection of the liquid from the liquid jet recording head, the inner wall of the liquid container tends to deform at the portion which is easiest to deform under the constraint described above. Since at least one of the substantially flat maximum surface area sides of the polyhedron shape, is not fixed to the inner wall, the deformation starts at substantially the central portion of the internal wall surface corresponding to this side.

Since the side at which the deformation starts, is flat, it smoothly and continuously deforms toward the side opposite therefrom corresponding to the decrease amount of the ink in the ink accommodating portion. Therefore, during the repeated ejection and non-ejection, the liquid accommodating portion does not deform substantially non-continuously, so that further stabilized negative pressure can be maintained, which is desirable for the liquid ejection of the liquid jet recording apparatus.

In this embodiment, the maximum surface area sides are opposed to each other and are not fixed to the outer wall and therefore are easily separable from the outer wall thereat, and therefore, the two opposite sides deform substantially simultaneously toward each other, so that maintaining of the negative pressure and the stabilization of the negative pressure during the liquid ejections can be further improved.

The volume of the ink container for the ink jet in this embodiment is usually approx. 5–100 cm[+]3[+], and is 500 cm[+]3[+] at a typical maximum.

A ratio of size of the maximum surface area side to the other sides of the liquid container can be determined in the following manner. As shown in FIG. 6 and 7, first, a rectangular parallelopiped of minimum size capable of containing therein the ink container is taken. The edges of the rectangular parallelopiped are designated by 11, 12 and 13 (length of edge 11 is not less than that of the edge 12, which is larger than that of the edge 13). It is desirable that ratio of the lengths of the edges 11 and 13 is approx. 10:1—approx. 2:1. In this embodiment, the area of the maximum area surface is larger than the total sum of the areas of the surfaces adjacent thereto. By this, when the ink container has a substantially rectangular parallelopiped configuration, the size of the maximum surface area side can be determined relative to the all surface area.

The experiments have been carried out with a liquid container having a thickness of approx. 100 microns at the central portion of the inner wall, and having a thickness of several—10 microns adjacent to the corner. In this case, the corner is provided by a crossing portion of the 3 surfaces, the strength of the corner substantially corresponds to that of the tripled thickness namely 10×3=30 microns approx.

In the initial stage of the start of the liquid discharge, the desired negative pressure can be produced by the constraint of the collapse of the corners and the crossing portions between the surfaces or sides.

With the further discharge of the liquid, the deformation occurs and increase at the center portions of the maximum area sides of the container. Then, the corners of the sides of the inner wall begin to become away form the corresponding corners of the outer wall. Immediately after the separation of the corners, the original configuration of the corners tend to be maintained so that deformation of the corners is constrained. However, with further liquid discharge, the configuration of the corners are gradually deformed since the thickness is as small as 100 microns.

However, all of the corner constituting the liquid container are not simultaneously separated and deformed, but they occur in the predetermined precedence order.

The precedence order is determined by the configuration of the liquid container, corner conditions such as film thickness, the position of the pinch-off portion where the inner wall is welded and is sandwiched by the outer wall, or the like. By the provision of the pinch-off portion at the positions as in this embodiment, the deformation of the inner wall and the separation thereof from the outer wall can be regulated at the positions, so that irregular deformation of the inner wall can be prevented. Additionally, the provisions of the pinch-off portions at opposite positions as in this embodiment, the negative pressure can be further stabilized.

By the subsequent separation of the corners constituting the liquid container, the predetermined negative pressure can be produced stably form the initial stage of the liquid discharge to the end thereof. With the thickness of the inner wall about 100 microns as in this embodiment, the crossing portion between the adjacent surfaces and the corners are irregularly deformed namely toward the liquid supplying portion, at the time when the liquid is used up.

The similar experiments were carried out with a liquid container having a thickness of 100–400 microns at the central portions of the inner wall and a thickness of 20–200 micron adjacent to the corners. In such a case, the strength of the corners were quite higher than in the foregoing sample of the container.

With this container, the predetermined negative pressure were produced at the initial stage of the liquid discharge, similarly to the foregoing example. With the further consumption of the ink, the inner wall begin to gradually separate from the outer wall at the central portion of the sides. Corresponding to the deformation, the corners begin to separate from the corresponding corners of the outer wall. The deformation of the corners is small even after quite a large amount of the liquid is discharged. Since the corner is separated from the outer wall with the initial configuration is substantially maintained, the negative pressure is stabilized. At the end of the consumption of the ink, the configuration is stabilized, so that negative pressure is provided stably to the end of use of the ink with the minimum remaining amount of the ink.

As a result of additional experiments, it has been found that stabilized negative pressure can be generated when the thickness adjacent to the central portion of the inner wall is 100–250 microns, and the thickness adjacent to the corner is 20–80 microns.

Similar investigation were made as to a simply cylindrical container. Here, the cylindrical configuration means a cylindrical container having a height larger than the diameter thereof.

With such a cylindrical container, the strength of the side is so high because of the curved surface thereof, that container does not collapse when it is used for the ink jet recording, The high strength structure provided by the curved surface withstand the inside pressure reduction. Therefore, the internal negative pressure tends to be too large.

When the inside liquid is forcedly sucked out, the curved side suddenly collapses, and simultaneously, a part of the end surface is significantly buckled. It is very difficult to produce stabilized negative pressure with the use of the cylindrical configuration, and therefore, it does not suit for the ink jet recording.

FIG. 5 shows a relation between the ink use amount of the ink accommodating portion and the negative pressure of the ink container in the ink container according to this embodiment.

FIG. 8 shows a relation between the ink use amount of the ink accommodating portion and the negative pressure of the ink container in the ink container according to this embodiment. In FIG. 8, the abscissa represents the ink discharge amount, and the ordinate represents the negative pressure. In this Figure, the negative static pressure is plotted with square marks. A total negative pressure which is a sum of the negative static pressure and the dynamic negative pressure produced when the ink flows, is plotted by "+" marks.

Here, the negative pressure in the ink accommodating portion is preferably as follows.

First, the negative static pressure at the time of shipment of the ink containers to the market is approx. Relative to the ambient pressure, and desirably, −2 to 30 mmAq. approx, If the pressure is positive at the delivery, a proper negative pressure can be provided by an initial refreshing operation in the main assembly of the "the state at the time of delivery" recording device, for example. Here, "the state at the time of delivery" is not limited to the initial state shown in FIG. 7, (*a*1) and (*a*2). If the negative pressure is maintained, the container may contain a amount of the ink which is slightly smaller than the maximum accommodatable amount of the ink accommodating portion.

Secondly, the pressure difference between when the recording is effected and when it is not effected, is small, namely, the difference between the negative static pressure and the total pressure is small. This is accomplished by reducing the dynamic pressure, The dynamic pressure in the ink accommodating portion per se can be neglected as contrasted to the ink accommodating portion using a porous material and therefore, the small dynamic pressure can be easily accomplished.

Thirdly, the change in the negative static pressure due to the change of the ink amount in the ink accommodating portion is small form the initial state to the final state. In a simple structure of the ink accommodating portion, the negative static pressure changes linearly or non-linearly relative to the ink amount existing in the ink accommodating portion, and therefore, the change ratio of the static pressure is large. However, in the ink container of this embodiment, the change of the negative static pressure is small from the initial stage to immediately before final state, so that substantially stabilized negative static pressure is accomplished.

The description will be made as to the manufacturing method according to this embodiment.

The liquid container of an embodiment of the present invention has a double wall structure of molding resin material, wherein the outer wall has a thickness to provide high strength, and the inner wall is of soft material. With small thickness, thus permitting it to follow the volume variation of the liquid. Furthermore, it has a small thickness, thus permitting it to follow the volume variation of the liquid. It is preferable that inner wall has a anti-liquid property, and the outer wall has a shock resistant property or the like.

In this embodiment, the manufacturing method for the liquid container uses a blow molding method with the use of blowing air. This is for the purpose of forming the wall constituting the liquid container from a resin material not expanded substantially. By doing so, the inner wall of the liquid container constituting the ink accommodating portion can resist the load substantially uniformly in ay direction. Therefore, despite the swing motion, in any direction, of the liquid in the inner wall of the liquid container after some amount of the ink is consumed, the inner wall can assuredly maintain the liquid, thus improving the total durability of the liquid container.

As for the blow molding method, there are a method using injection blow, a method using direct blow, and a method using double wall blow. The description will be made as to the method using the direct blow molding used in this embodiment.

The injection nozzle is in the form of a multi-layer nozzle, and it injects the inside resin material and the outside resin material simultaneously into the mold to produce an integral first and second parison. The materials of the inside resin material and the outside resin material are so selected as to avoid the welding of the resin materials at the contact portion therebetween. When similar materials are to be used form the standpoint of the liquid contact property relative to the ink, the inside material or the outside material may be of multi-layer structure so that resin materials are supplied in such a manner that different kind materials are present in the contact portion. The supply of the inside resin material is uniform along the circumference ideally, but it may be locally thin to provide a structure easily followable to the variation of the inside pressure.

A metal mold is moved to sandwich the integral parison, and the air is injected to effect blow molding into the shape of the metal mold. At this time, the inner wall and the outer wall are closely close contacted without gap therebetween. The parison is processed while it has a viscosity, and therefore, both of the outer wall resin material and the inner wall resin material are free of orientation property. By the use of the blow molding for manufacturing the liquid container, the number of steps and the number of parts are reduced, so that yield is improved; and additionally, the configuration oft inner wall 102 can be made such that corner portions of the inner wall 102 correspond to the corner, portions of the outer wall 101.

Then, the inner and outer walls are separated at other than the ink supplying portion. As for another separation method, the molding resin materials of the inner wall and the outer wall have different thermal expansion coefficients (shrinkage rates). In this case, the separation is effect automatically by decrease of the temperature of the molded product after the blow molding, so that number of manufacturing steps can be decreases. The portion having been sandwiched by the molds during the blow molding may be imparted by external force after the molding to separate the outer wall from the inner wall, and the gap therebetween may be brought into communication with the air, so that gap can be used as an air vent.

Thus, according to the embodiment of the present invention, there is provided a liquid container for a head cartridge, wherein the thickness of the inner wall such that portion constituting the corner portions is smaller than the center portion in each of the sides of the prism-like, so that liquid can be supplied with stabilized negative pressure.

By the use of the container for the liquid ejection head, the inner wall deforms closely in response to the supply negative pressure of the liquid, external mechanical force, change in the temperature and change in the pressure, so that pressing the liquid container is constant, and the supply of the liquid to the liquid ejecting head is smooth.

According to the present invention, the internal wall surface corresponding to at least one of the outer wall surfaces having the maximum surface area among the flat sides, does not have a portion fixed to the outer wall, and is readily separable from the outer wall, so that when the inner wall deforms due to the consumption of the liquid, the inner wall side stably starts to deform, thus permitting stabilized liquid ejection with stabilized negative pressure maintained.

The reduction of the number of parts eases the quality control of parts, simplify the manufacturing step, and enhancing the accuracy and yield.

Furthermore, the liquid containing portion is free of absorption member therein, and therefore, the material of the liquid to be contained is less limited, and the voltage capacity is increased, as compared with the inside volume of the liquid container.

By the combination of the recording head wherein the liquid loss during the recovery and the liquid container having a high ink accommodation efficiency and high usage efficiency, the ink jet cartridge of the present invention can use the limited space effectively, thus decreasing the frequency of exchange of the cartridge.

The liquid is directly accommodated in the liquid containing portion, and the liability of introduction of foreign matter such as eluded material, is low, and the liquid supply path from the liquid containing portion to the recording head is very simple.

In the case of the conventional liquid container accommodating a negative pressure producing member such as foamed urethane resin material, the flow resistance of the negative pressure producing member per se is quite large, and the supply path from the liquid containing portion to the recording head is complicated in the liquid containing portion. Depending on the design of the negative pressure producing member, the flow resistance of the liquid containing portion when the liquid is gradually consumed, can be made small. However, for a forced high speed refilling for each ejection in a recording head capable of ejecting the liquid at high frequency than the conventional recording head, there is a difficulty in responsivity.

According to this invention, the dynamic negative pressure of the liquid container per se is small, and therefore, the follow-up property to the forced high speed refilling from the upstream of the flow path using the pressure upon bubble collapse, is very good. The container of the present invention is effective to respond the high speed refilling of the recording head. According to this invention, the shape of the liquid containing portion smoothly changes to maintain the negative pressure to accomplish the responsivity to the instantaneous change.

(Second Embodiment)

Figure 9A:
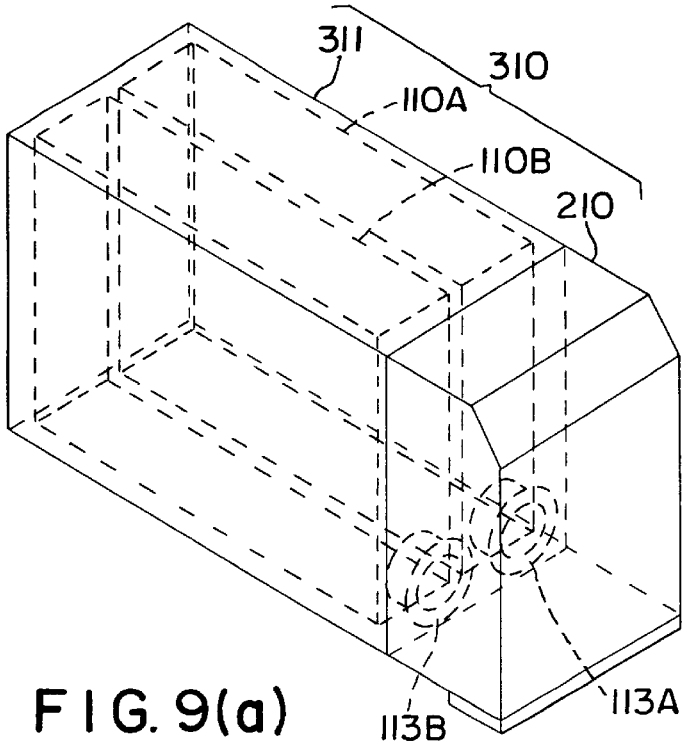
FIGS. 9(*a*) to 9(*c*) are schematic views of a device according to a second embodiment.
Figure 9B:
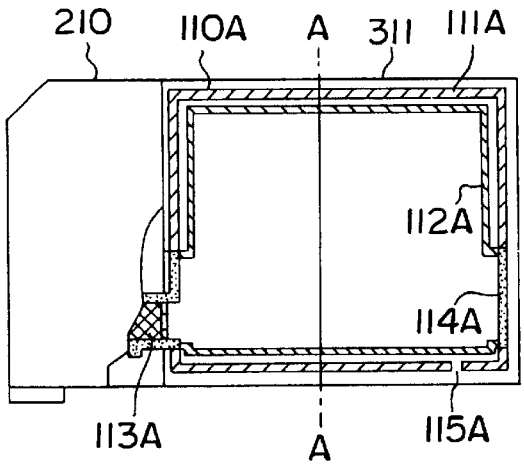
Figure 9C:
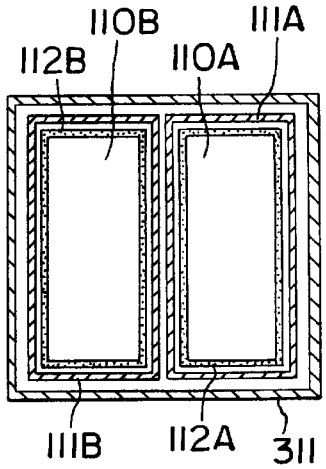

FIG. 9, (*a*), (*c*) shows a head cartridge according to a second embodiment of the present invention, wherein (*a*) is a perspective view, (*b*) is a sectional side view, and (*c*) is a sectional view taken along a line A—A in FIG. 9, (*b*).

This embodiment is different from the first embodiment in that liquid flow path is a double path structure in the liquid ejecting head 210 of the head cartridge 310, wherein the liquid for bubble generation by head (bubble generation liquid) and the liquid to be mainly ejected (ejection liquid) are different from each other. Therefore, the container has two liquid containers 110A, 110B for the bubble generation liquid and the ejection liquid, respectively. The liquid containers 110A, 110B are integral with the recording head, and is enclosed by the casing 311.

Each of the liquid containers 110A, 110B, has outer walls 111A, 111B which is substantially not influenced by discharge of the liquid and an inner wall 112A, 112B which is separable from the outer wall and which deforms in response to the discharge of the liquid, similarly to the foregoing liquid container 100, wherein the liquids are contained in the liquid containing portions constituted by the sinner walls. The outer wall is provided with air vent 115A, 115B for each, to permit introduction of the air from an unshown air vent provided in the tube member 311. Pinch-off portions 114A, 114B are provided at the same positions as in first embodiment.

The container 110 accommodating the ejection liquid is in fluid communication with the liquid ejecting head through a liquid discharging outlet 113A, and the ejection liquid is supplied to the common liquid chamber for the ejection liquid in the liquid ejecting head through the liquid discharging outlet 113A from the liquid containing portion of the container 110A. On the other hand, the container 110B accommodating the bubble generation liquid is in fluid communication with the liquid ejecting head through the liquid discharging outlet 113B, and the bubble generation liquid is supplied to a common liquid chamber for the bubble generation liquid in the head portion through the liquid discharging outlet 113B from the liquid containing portion of container 110B, similarly to the ejection liquid.

In this embodiment, similarly to the first embodiment, the outer walls 111A, 111B of the liquid containers 110A, 110B may function as the casing 311.

Figure 10:
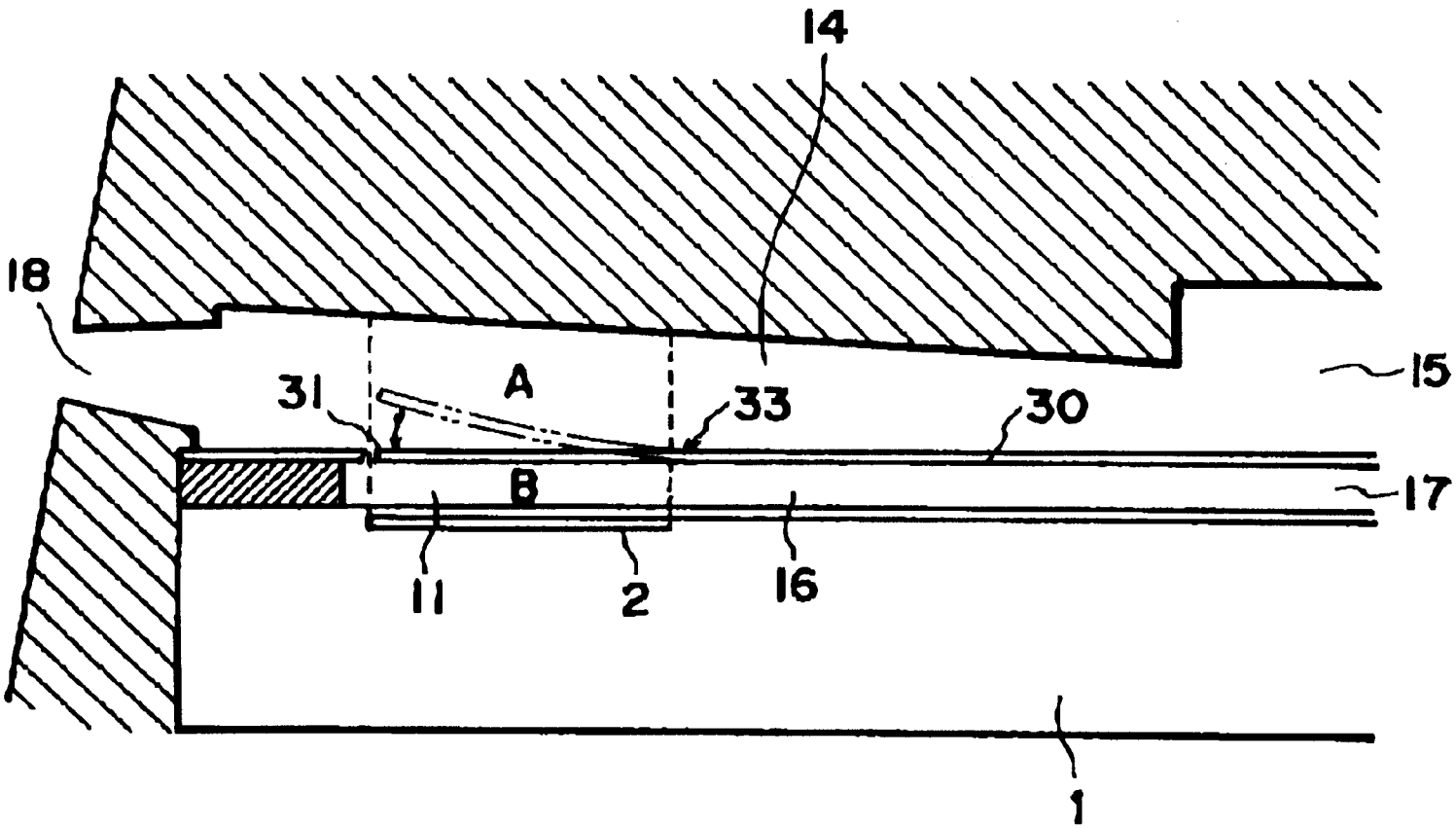
FIG. 10 is a sectional view of a liquid ejecting head (two paths) usable with the head cartridge according to the embodiment of the present invention.
Figure 11:
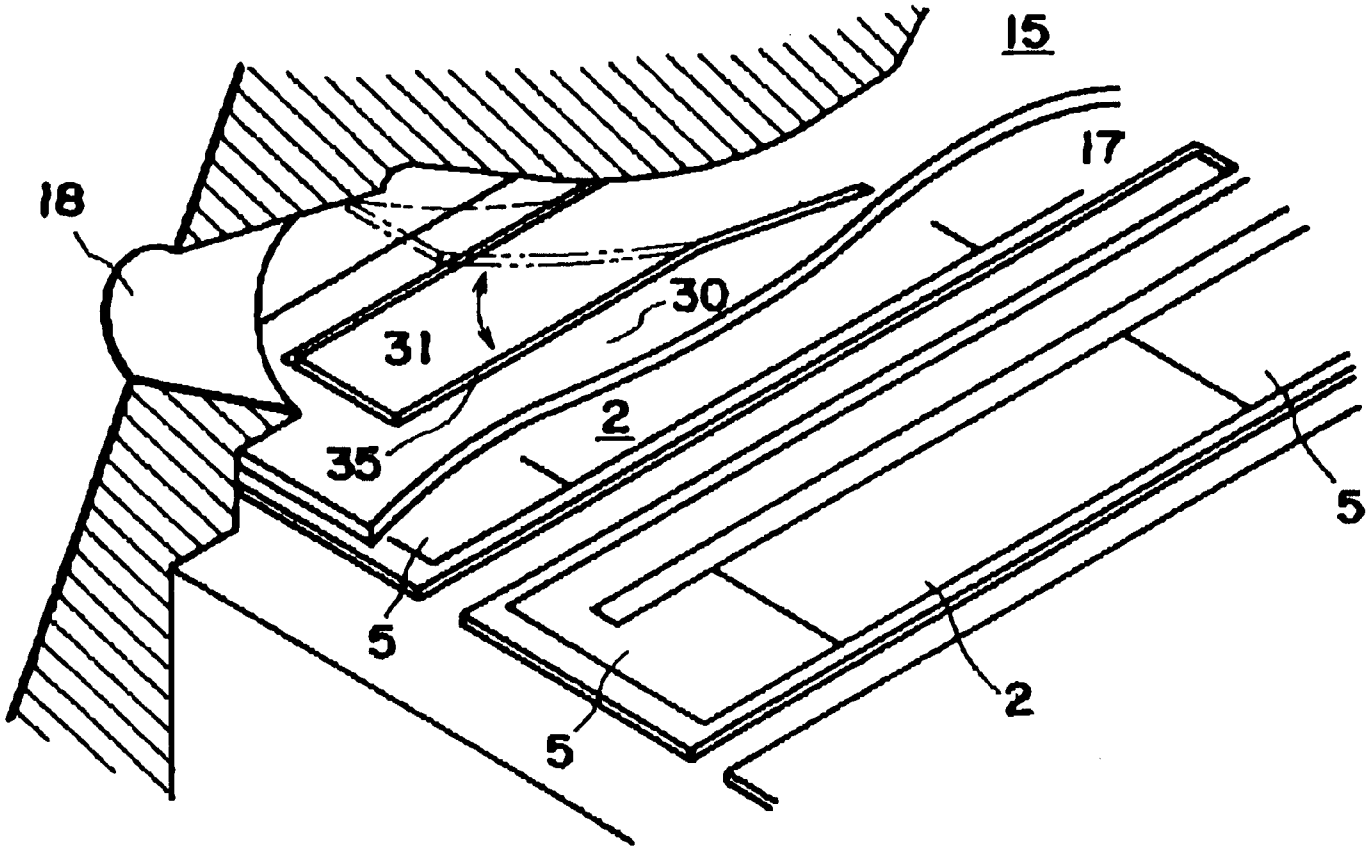
FIG. 11 is a partly broken perspective view of a liquid ejecting head usable with a head cartridge according to the embodiment of the present invention.

FIG. 10 is a sectional schematic view in a direction along the flow path of the liquid ejecting head of this embodiment.

In the liquid ejecting head of this embodiment, a second liquid flow path 16 for the bubble generation is provided on the element substrate 1 which is provided with a head generating element 2 for supplying thermal energy for generating the bubble in the liquid, and a first liquid flow path 14 for the ejection liquid in direct communication with the ejection outlet 18 is formed thereabove.

The upstream side of the first liquid flow path is in fluid communication with a first common liquid chamber 15 for supplying the ejection liquid into a plurality of first liquid flow paths, and the upstream side of the second liquid flow path is in fluid communication with the second common liquid chamber for supplying the bubble generation liquid to a plurality of second liquid flow paths.

Between the first and second liquid flow paths, there is a separation wall 30 of an elastic material such as metal so that first flow path and the second flow path are separated. In the case that mixing of the bubble generation liquid and the ejection liquid should be minimum, the first liquid flow path 14 and the second liquid flow path 16 are preferably isolated by the partition wall. However, when the mixing to a certain extend is permissible, the complete isolation is not inevitable.

The movable member 31 is in the form of a cantilever wherein such a portion of separation wall as is in an upward projected space of the surface of the heat generating element (ejection pressure generating region, region A and bubble generating region 11 of the region B in FIG. 10) constitutes a free end by the provision of the slit 35 at the ejection outlet side (downstream with respect to the flow of the liquid), and the common liquid chamber (15, 17) side thereof is a fulcrum or fixed portion 33. This movable member 31 is located faced to the bubble generating region 11 (B), and therefore, it functions to open toward the ejection outlet side of the first liquid flow path upon bubble generation of the bubble generation liquid (in the direction indicated by the arrow, in the Figure). In an example of FIG. 16, too, a partition wall 30 is disposed, with a space for constituting a second liquid flow path, above an element substrate 1 provided with a heat generating resistor portion as the heat generating element 2 and wiring electrodes 5 for applying an electric signal to the head generating resistor portion.

As for the positional relation among the fulcrum 33 and the free end 32 of the movable member 31 and the heat generating element, are the same as in the previous example.

In the previous example, the description has been made as to the relation between the structures of the liquid supply passage 12 and the heat generating element 2. The relation between the second liquid flow path 16 and the heat generating element 2 is the same in this embodiment.

Figure 12A:
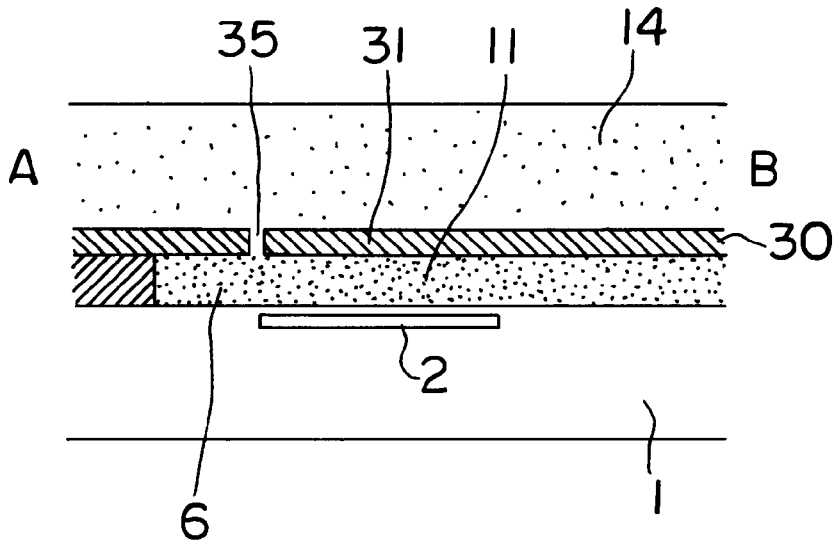
FIGS. 12(*a*) and 12(*b*) are illustrations of operation of a movable member.
Figure 12B:
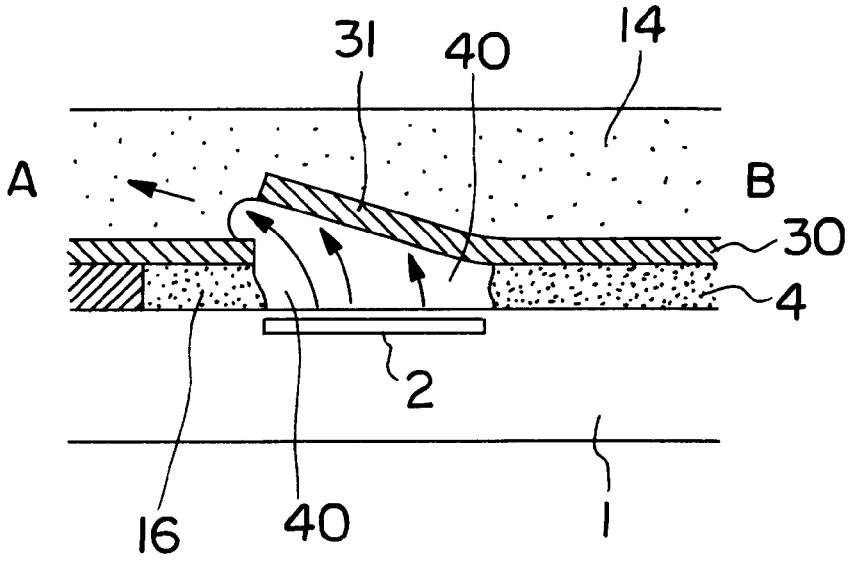

Referring to FIG. 12, the operation of the liquid ejecting head of this embodiment will be described.

The sued ejection liquid in the first liquid flow path 14 and the used bubble generation liquid in the second liquid flow path 16 were the same water base liquids.

By the heat generated by the heat generating element 2, the bubble generation liquid in the bubble generation region in the second liquid flow path generates a bubble 40, by film boiling phenomenon as described hereinbefore.

In this embodiment, the bubble generation pressure is not released in the three directions except for the upstream side in the bubble generation region, so that pressure produced by the bubble generation is propagated concentratedly on the movable member 6 side in the ejection pressure generation portion, by which the movable member 6 is displaced from the position indicated in FIG. 12, (*a*) toward the first liquid flow path side as indicated in FIG. 12, (*b*) with the growth of the bubble. By the operation of the movable member, the first liquid flow path 14 and the second liquid flow path 15 are in wide fluid communication with each other, and the pressure produced by the generation of the bubble is mainly propagated toward the ejection outlet in the first liquid flow path (direction A). By the propagation of the pressure and the mechanical displacement of the movable member, the liquid is ejected through the ejection outlet.

Figure 19A:
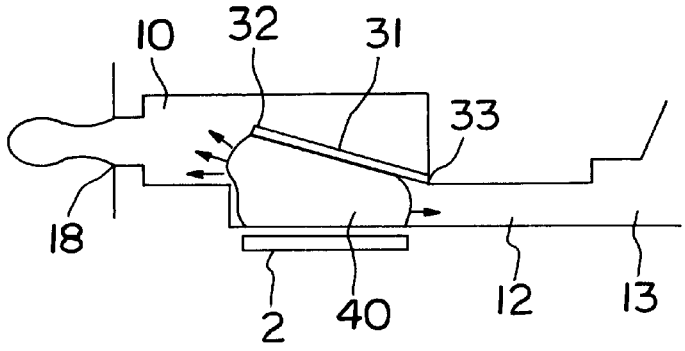
FIGS. 19(*a*) to 19(*c*) are schematic sectional views of a modified example of a liquid ejecting head usable with a head cartridge according to an embodiment of the present invention.
Figure 19B:
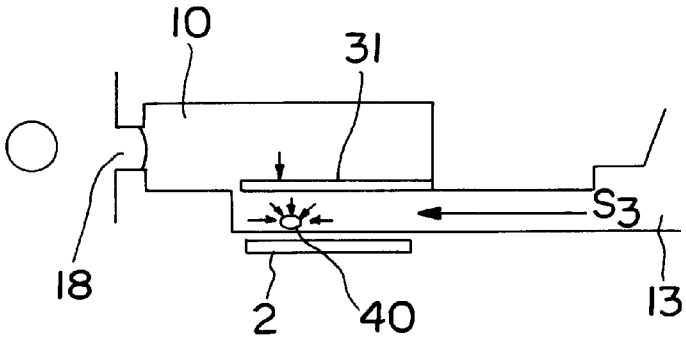
Figure 19C:
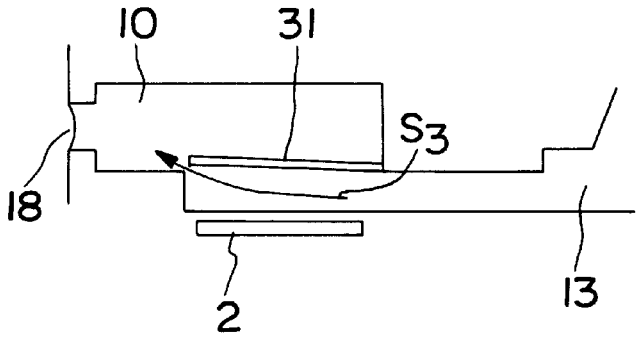

Then, with the contraction of the bubble, the movable member 31 returns to the position indicated in FIG. 19, (*a*), and correspondingly, an amount of the liquid corresponding to the ejection liquid is supplied from the upstream in the first liquid flow path 14. In this embodiment, the direction of the liquid supply is correctional with the closing of the movable member as in the foregoing embodiments, the refilling of the liquid is not impeded by the movable member.

The major functions and effects as regards the propagation of the bubble generation pressure with the displacement of the movable wall, the direction of the bubble growth, the prevention of the back wave and so on, in this embodiment, are the same as with the first embodiment, but the two-flow-path structure is advantageous in the following points.

The ejection liquid and the bubble generation liquid may be separated, and the ejection liquid is ejected by the pressure produced in the bubble generation liquid. Accordingly, a high viscosity liquid such as polyethylene glycol or the like with which bubble generation and therefore ejection force is not sufficient by heat application, and which has not been ejected in good order, can be ejected. For example, this liquid is supplied into the first liquid flow path, and liquid with which the bubble generation is in good order is supplied into the second path as the bubble generation liquid. An example of the bubble generation liquid a mixture liquid (1–2 cP approx.) of ethanol and water (4:6), by doing so, the ejection liquid can be properly ejected.

Additionally, by selecting as the bubble generation liquid a liquid with which the deposition such as burnt deposit does not remain on the surface of the heat generating element even upon the heat application, the bubble generation is stabilized to assure the proper ejections.

The above-described effects in the foregoing embodiments are also provided in this embodiment, the high viscous liquid or the like can be ejected with a high ejection efficiency and a high ejection pressure.

Furthermore, liquid which is not durable against heat is ejectable. In this case, such a liquid is supplied in the first liquid flow path as the ejection liquid, and a liquid which is not easily altered in the property by the hat and with which the bubble generation is in good order, is supplied in the second liquid flow path. By doing so, the liquid can be ejected without thermal damage and with high ejection efficiency and with high ejection pressure.

The liquid container for accommodating the ejection liquid and the bubble generation liquid is the same as the liquid container used in the first embodiment, the liquid to be accommodated is less limited as compared with the case of using an absorbing material such as foamed urethane resin material in the liquid containing portion, as has been described with respect to the first embodiment.

With the head cartridge of this embodiment is used, the advantageous effects of the first embodiment is provided, and in addition, height viscosity liquid or liquid containing pigment can be ejected, thus increasing the range of usable liquid.

Similarly to the first embodiment, the followability to the forced high speed refilling using the pressure upon the bubble collapse.

The preferably property of the liquid in each of the paths will be described. The property of the liquid around the movable member, assures the motion of the movable member. Referring to FIG. 12, the description will be made.

The function provided by the nature is that internal pressure in the first liquid flow path 14 and the internal pressure in the second liquid flow path 16 are made different.

As has been described hereinbefore, the first liquid flow path 14 and the second liquid flow path 16 are in fluid communication with each other only through the slit 35 around the movable member 31. As shown in FIG. 12, as for the liquid in the first liquid flow path 14, namely, the ejection liquid, the internal pressure (static head) is selected such that negative pressure is present at the ejection outlet 18 and the slit 35 to maintain a meniscus M at the ejection outlet 18, normally. Similarly, as for the liquid in the second liquid flow path 16, namely, the bubble generation liquid, the internal pressure (static head) is selected such that meniscus is held at the slit 35. Thus, the bubble generation liquid and the ejection liquid are in the state of negative pressure to hold the meniscus at the slit 35, but when this state last long, there is a liability that one of the liquids enters, or disperses into, the other liquid flow path adjacent thereto through the slit 35.

When the ejection liquid has such a nature that burnt deposit easily produced on the heat generating element 2 due to the heat produced thereby, the introduction of the ejection liquid into the second liquid flow path 16, the burnt deposit may be easily produced on the heat generating element 2, by which the liquid ejection is not stable.

In the following Embodiments 3–5, the negative pressure balance in the container accommodating the ejection liquid is controlled to maintain the static head of the bubble generation liquid much higher than the static head of the ejection liquid, thus preventing introduction of the ejection liquid into the second liquid flow path 16 having the heat generating element 2 during printing operation.

(Embodiment 3)

Figure 13A:
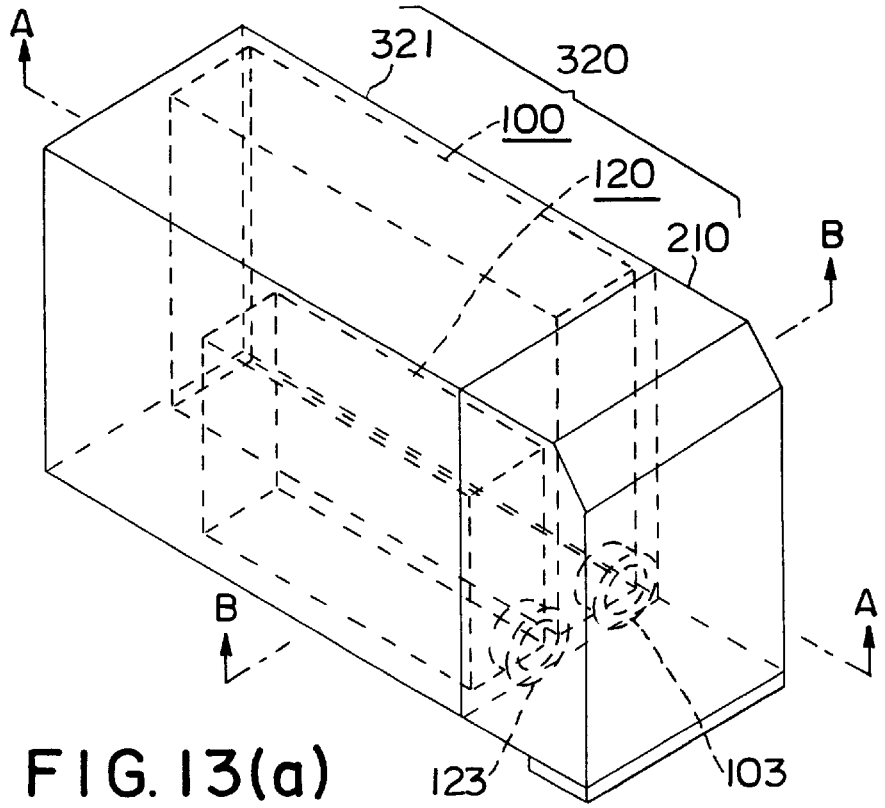
FIGS. 13(*a*) to 13(*c*) are schematic views of a head cartridge according to a third embodiment of the present invention.
Figure 13B:
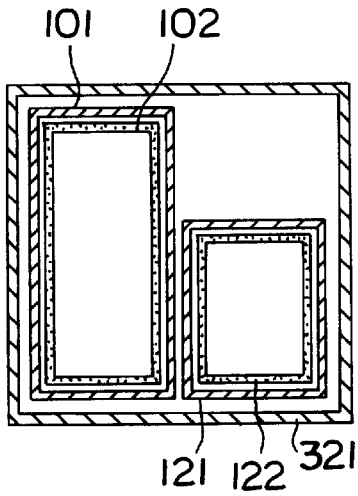
Figure 13C:
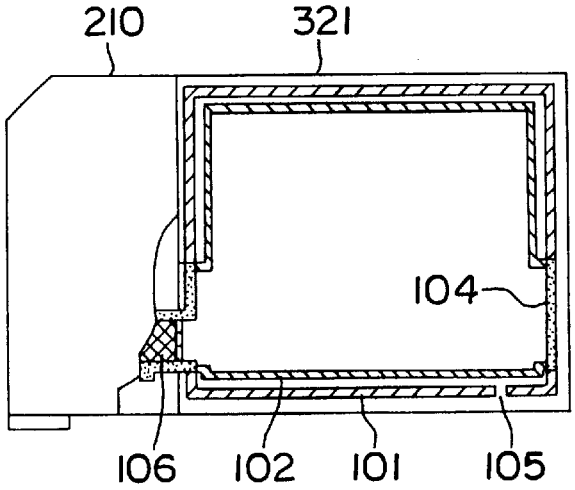

FIG. 13 shows the head cartridge 320 in the third embodiment of the present invention. In FIG. 13, (*a*) is a perspective view of the head cartridge 320; (*b*), a sectional view of the head cartridge 320 at a plane B—B in (A); (*c*) is a sectional view of the head cartridge 320 at a plane A—A in (*a*). In this embodiment, the internal pressure of the liquid path in the head cartridge is controlled by regulating the internal pressure of a liquid container itself, wherein the internal pressure of a liquid container is controlled on the basis of the configuration of the liquid container.

As is evident from FIG. 13, the head cartridge 320 comprises a liquid ejecting portion 210 similar to the one described in the second embodiment, and two liquid containers 100 and 120 which are substantially similar to each other in configuration. Both liquid containers are formed by the previously described blow molding method. They are substantially the same in the thickness of the internal and external walls, the material, and the structure, except for the size, and are enclosed in a housing 321, being connected to the recording head.

In the case of a liquid containers such as the one in this embodiment which is formed by blow molding, the internal pressure of the container is essentially dependent on the internal volume of the liquid container, that is, the size of the largest wall of the container, provided that the container remains substantially the same in the configuration, wall thickness, and internal and external wall material. More specifically, in the case of a liquid container such as the one in this embodiment which is formed by blow molding, the deformation of the liquid container first starts from the largest wall (or walls), essentially remaining on this largest wall, as the liquid therein is consumed, whereas the corners thereof which surround the largest wall regulate the deformation of the liquid container, controlling thereby the internal pressure of the liquid container. Therefore, when there are two ink containers, the internal pressure which changes with ink consumption is smaller in one of the two liquid containers, the largest wall of which is larger than the largest wall of the other, and as a result, the internal pressure of the former remains smaller than the internal pressure of the latter; the negative pressure of the former remains smaller than the negative pressure of the latter.

Also referring to FIG. 13, in this embodiment, the largest wall of the liquid container 100 is larger than the largest wall of the liquid container 120, and therefore, the internal pressure (head pressure) of the liquid container 100 is larger than that of the liquid container 120. Thus, the internal pressure of the second liquid flow path can be rendered larger than that of the first liquid flow path, by means of using the liquid container 100 as the container for the bubble generation liquid. With this arrangement, it is possible to prevent the ejection liquid from flowing into the second liquid flow path; in other words, it is possible to prevent the occurrence of such a phenomenon that liquid ejection becomes instable or impossible due to the baked deposit accumulated on the heat generating member by the ejection liquid which enters the second liquid flow path.

On the other hand, it is also possible that making the head pressure of the bubble generation liquid higher than that of the ejection liquid causes the bubble generation liquid to flow into the first liquid flow path. However, the amount of the bubble generation liquid which flows into the ejection liquid will be very small even if the bubble generation liquid actually flows into the ejection liquid. Therefore, there will be no problem. Obviously, the configuration of the two liquid containers has only to be designed to generate desirable internal pressure difference between the two.

Further, the large and small liquid containers in this embodiment can be easily formed by choosing a proper metallic mold and a proper parison diameter, for each container, to give them a desirable configuration.

Described in this embodiment was a method for controlling the negative pressure by changing the size of the largest wall of a liquid container. However, the present invention is not limited to this embodiment; for example, the negative pressure may be controlled by changing the dimension of a liquid container in terms of width and/or height. In such a case, the configuration of a liquid container may be optionally changed according to the required internal head pressure.

(Embodiment 4)

Figure 14A:
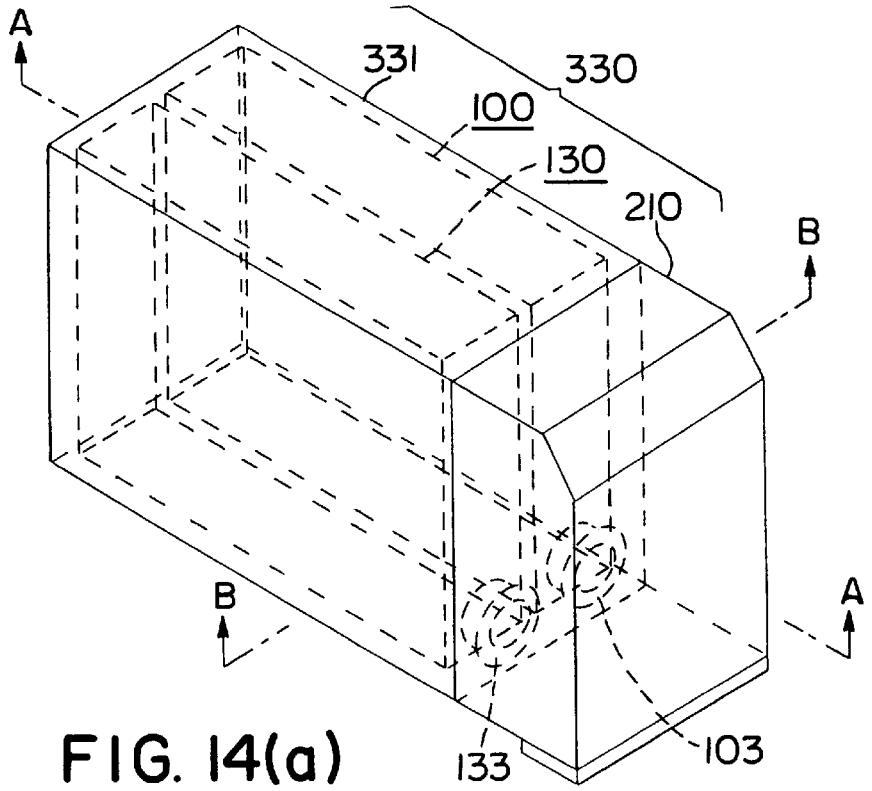
FIGS. 14(*a*) to 14(*c*) are schematic views of a head cartridge according to a fourth embodiment of the present invention.
Figure 14B:
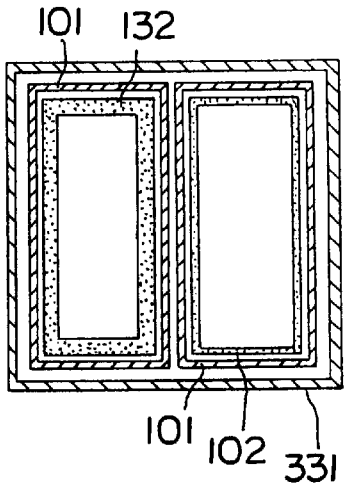
Figure 14C:
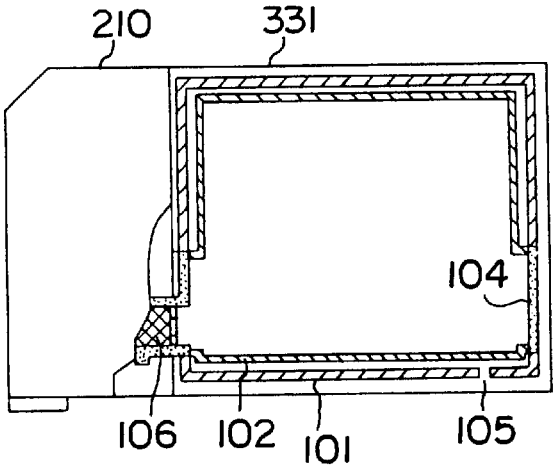

FIG. 14 shows the head cartridge 330 in the fourth embodiment of the present invention. In FIG. 14, (*a*) is a perspective view of the head cartridge 330; (*b*), a sectional view of the head cartridge 330 at a plane B—B in (*a*); and (*c*) is a sectional view of the head cartridge 330 at a plane A—A in (*a*). In this embodiment, a method for controlling the internal pressure of the head cartridge 330 based on the difference in wall (film) thickness between two containers will be described.

The head cartridge in this embodiment 330 comprises a liquid ejecting portion 210 and two liquid containers 100 and 130. Both containers are formed by blow molding, and are equal in configuration, the material for the internal and external walls, and thickness of the external wall 101, except for the thickness of the internal wall; the internal wall 132 of the liquid container 130 is thicker than that of the internal wall 102 of the liquid container 100.

When a liquid container is formed by blow molding, the center portion of the wall becomes slightly thicker than the corner portions, which is one of the characteristics of a liquid container manufactured by blow molding. As described in the preceding embodiments, the internal pressure of a liquid container is primarily related to the size of the largest wall of the container. Thus, the wall thickness, which is compared in this embodiment, is defined as the thickness of the center portion of the largest wall of a liquid container.

Under the conditions which will be described in this embodiment, the internal pressure of a blow molded liquid container is controlled dominantly by the thickness of the internal wall. In other words, the thicker is the internal wall of a container, the higher is the negative pressure the container generates.

Therefore, the ejection liquid can be prevented from flowing into the bubble generation liquid side, as described in the first embodiment, by using, as the container for the ejection liquid, the liquid container 130 which is greater in wall thickness than the liquid container 100, and using the liquid container 100, as the bubble generation liquid.

The liquid containers in this embodiment can be easily formed by changing the parison diameter or the internal parison pressure during the aforementioned manufacturing process.

(Embodiment 5)

Figure 15A:
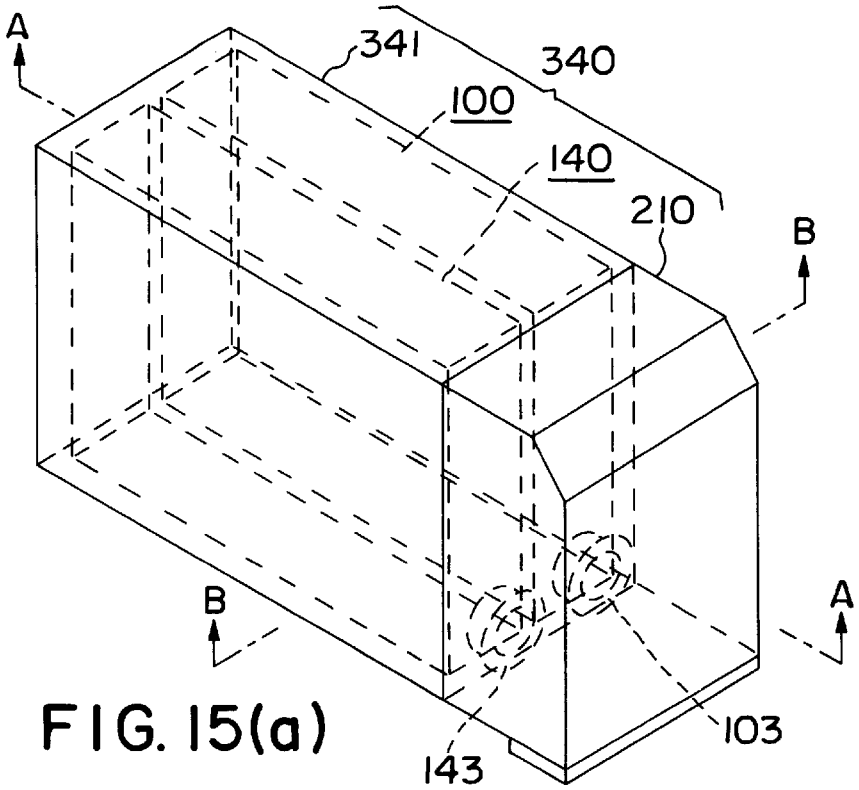
FIGS. 15(*a*) to 15(*c*) are schematic views of a head cartridge according to a fifth embodiment of the present invention.
Figure 15B:
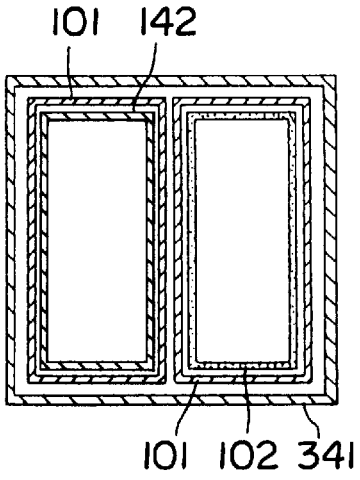
Figure 15C:
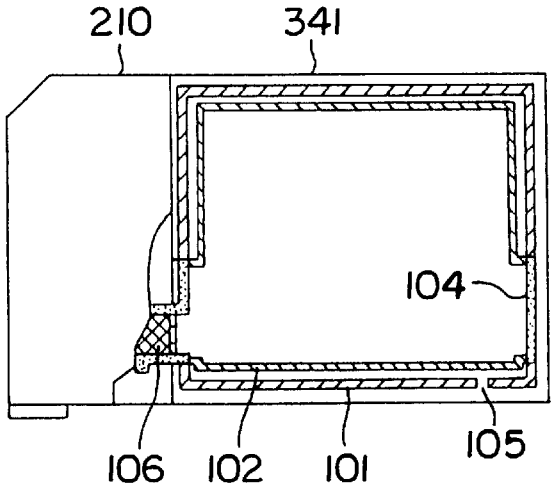

FIG. 15 shows the head cartridge 340 in the fifth embodiment of the present invention. In FIG. 15 (*a*) is a perspective view of the head cartridge 340; (*b*) a sectional view of the head cartridge 340 at a plane B—B in (*a*); (*c*) is a sectional view of the head cartridge 340 at a plane A—A in (*a*). In this embodiment, the internal pressure difference dependent upon difference in internal wall material will be described.

The head cartridge 340 in this embodiment comprises a liquid ejecting portion 210 and two liquid containers 100 and 140. The two liquid containers are equal in configuration, internal wall thickness, and external wall thickness, and are formed by blow molding. Both are the same in the material for the external wall 101, but are different in the material for the internal wall; the material of the internal wall 142 of the liquid container 140 is different from the material of the internal wall 102 of the liquid container 100.

More specifically, in this embodiment, the internal pressure is controlled on the basis of the strength of the material for the internal wall, in particular, the strength in terms of the tensile elastic coefficient. This method for controlling the internal pressure is based on the fact that the rate at which the internal pressure of a liquid container changes in response to the consumption of the liquid therein is proportional to the elastic coefficient of the wall of the liquid container. Therefore, a liquid container having internal walls formed of a material with a larger tensile elastic coefficient generates larger negative pressure than a liquid container having internal walls formed of a material with a smaller tensile elastic coefficient. In other words, the internal negative pressure of the former container tends to increases more rapidly at the beginning of ink consumption than that of the latent container, as depicted by the previously described negative pressure curve in FIG. 8.

Thus, the bubble generation liquid can be easily prevented from flowing into the ejection liquid side, by choosing the liquid container having internal walls formed of the material with a larger tensile elastic coefficient, for the ejection liquid.

At this time, resin material usable for forming the liquid container in accordance with the present invention will be described.

A liquid container in accordance with the present invention has a double wall structure; it has internals wall which come in contact with ink, and external walls which cover the internal walls from out side. Thus, it is desirable that the material for the internal wall displays flexibility when molded into thin wall, is resistant or compatible with liquid to be container, and is low in gas permeability, and the material for the external wall has high strength to protect the internal wall.

Generally speaking, noncrystalline resin such as NORIRU resin is low in heat absorptance, and crystalline resin such as polypropylene or polyethylene is high in heat absorptance. Polystyrene, polycarbonate, polyvinyl chloride, or the like can be listed as noncrystalline plastic. Polyacetal, polyamide, and the like, which partially crystalline under a certain condition, can be listed as crystalline plastic. Crystalline plastic has a glass transition temperature (Tg: temperature at which its molecules begin Brownian motion, and its phase changes from glass phase to rubber phase), and a relatively distinctive melting point. On the other hand, noncrystalline plastic has a glass transition temperature, but does not have a distinctive melting point.

The mechanical strength, specific volume, specific heat, thermal expansion coefficient, and the like, of plastic material suddenly change at its glass transition point. Thus, in order to improve the separativeness of the internal and external resin walls from each other, the combination of the plastic material for the internal and external walls can be chosen on the basis of these properties of plastic material. For example, NORIRU resin, a noncrystalline resin, may be used as the material for the external wall, while using polypropylene resin, a crystalline resin, as the material for the internal wall, so that the external wall becomes greater in mechanical strength, whereas the internal wall becomes greater in heat absorption and flexibility.

Polymer whose molecular structure exclusively container C—C bonds and C—H bonds is called nonpolar polymer, whereas polymer whose molecular structure contains a relatively large number of polar atoms such as O, S, N, halogens, or the like is called polar polymer. Nonpolar polymer is greater in intermolecular bond; nonpolar polymer plastic is greater in internal bonding force.

This property of plastic material can be used to improve the separativeness of the internal and external walls from each other; two nonpolar polymer resins different in intermolecular bond may be employed in combination, or a nonpolar polymer resin may be employed in combination with a polar polymer resin.

In other words, it is important that the best material combination should be chosen from among the materials which were listed above as the material for a liquid container in accordance with the present invention, in consideration of the separativeness of the internal and external walls from each other.

The desirable control can executed by combining the above described materials in consideration of the required pressure balance between the bubble generation liquid and the ejection liquid.

The two liquid containers in this embodiment can be easily manufactured simply by choosing different material for each liquid container. As is evident from the above description, different material was used only for the internal wall, while the same material is used for the external wall. As for the material for the external wall, it is desirable to have a reasonable degree of strength to protect the internal wall.

In these embodiment, only the inner wall is changed with the outer wall being the same, but the outer wall is preferably of a material separable from the inner wall and of a certain degree of strength to protect the inner wall.

(Other Embodiments)

Other embodiments of the ejection head and the liquid container will be described.

Ejection Head

In the first embodiment, the ejection liquid and the bubble generation liquid are the same, and therefore, either of the one path structure or the double path structure is usable.

FIG. 16 to FIG. 19 show a modified example of the one path structure of the first embodiment.

Figure 16:
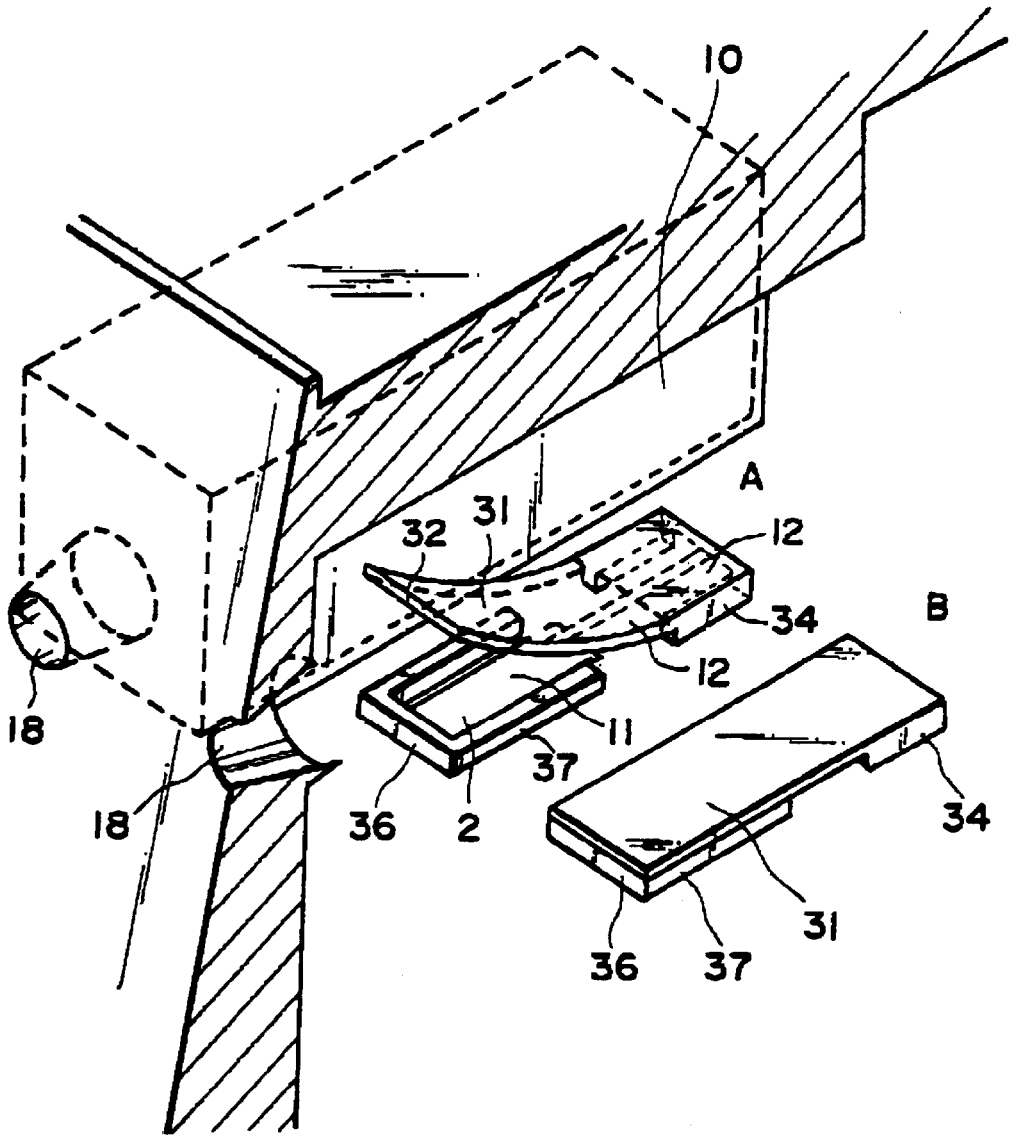
FIG. 16 is a partly broken perspective view of a modified example of a liquid ejecting head usable with a head cartridge according to an embodiment of the present invention.

FIG. 16 shows a modified example of the ejection head, wherein A shows a state in which the movable member is displaced (bubble is not shown), and B shows a state in which the movable member is in its initial position (first position). In the latter state, the bubble generation region 11 is substantially sealed from the ejection outlet 18 (between A and B, there is a flow passage wall to isolate the paths).

The movable member 31 in FIG. 16 is set on two lateral foundations 34, and a liquid supply passage 12 is provided therebetween. With this structure, the liquid can be supplied along a surface of the movable member faced to the heat generating element side and from the liquid supply passage having a surface substantially flush with the surface of the heat generating element or smoothly continuous therewith.

When the movable member 31 is at the initial position (first position), the movable member 31 is close to or closely contacted to a downstream wall 36 disposed downstream of the heat generating element 2 and heat generating element side walls 37 disposed at the sides of the heat generating element, so that ejection outlet 18 side of the bubble generation region 11 is substantially sealed. Thus, the pressure produced by the bubble at the time of the bubble generation and particularly the pressure downstream of the bubble, can be concentrated on the free end side of the movable member, without releasing the pressure.

At the time of the collapse of bubble, the movable member 31 returns to the first position, the ejection outlet side of the bubble generation region 31 is substantially sealed, and therefore, the meniscus retraction is suppressed, and the liquid supply to the heat generating element is carried out with the advantages described hereinbefore. As regards the refilling, the same advantageous effects can be provided as in the foregoing embodiment.

As shown in FIG. 16, the foundation 34 for supporting and fixing the movable member 31 is provided at an upstream position away from the heat generating element 2, and the foundation 34 has a width smaller than the liquid flow path 10 to supply the liquid to the liquid supply passage 12. The configuration of the foundation 34 is not limited to this structure, but may be anyone if smooth refilling is accomplished.

In this embodiment, the clearance between the movable member 31 and the heat generating element 2, was approx. 15 $\mu$m, but may be different if the pressure on the basis of the generation of the bubble is sufficiently transmitted to the movable member.

Figure 17:
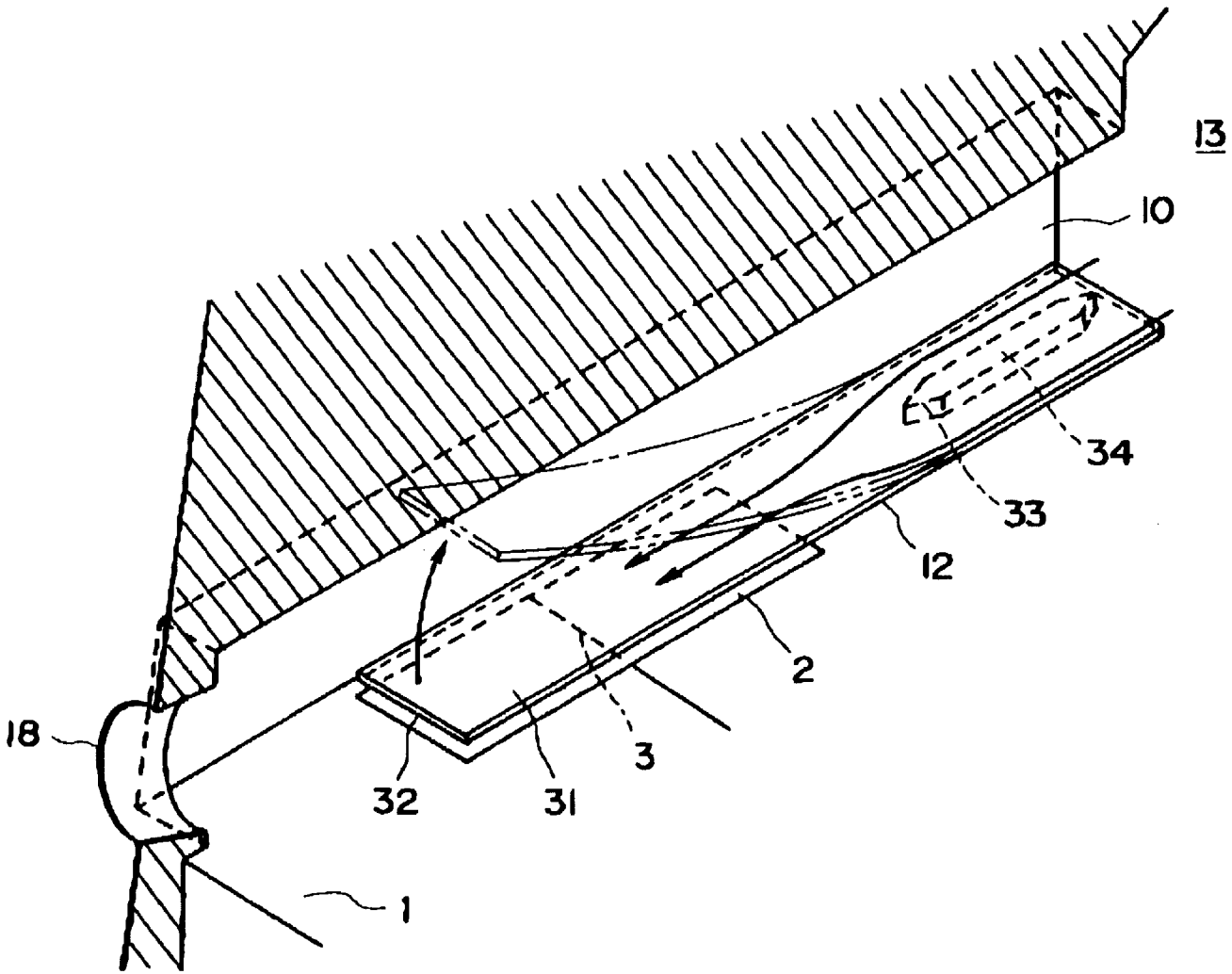
FIG. 17 is a partly broken perspective view of a modified example of a liquid ejecting head usable with a head cartridge according to an embodiment of the present invention.

In the modification of FIG. 17, a latitude is given to the generated bubble, and the downstream portion of the bubble (at the ejection outlet side of the bubble) which is directly influential to the droplet ejection, is regulated by the free end side of the movable member.

As compared with FIG. 3 (first embodiment), the head of FIG. 17 does not include a projection (hatched portion) as a barrier at a downstream end of the bubble generating region on the element substrate 1 of FIG. 3. In other words, the free end region and the opposite lateral end regions of the movable member, is open to the ejection outlet region without substantial sealing of the bubble generating region in this embodiment.

In the modified embodiment of FIG. 17, of the downstream portion of the bubble directly contributable to the liquid droplet ejection, the downstream leading end permits the growth of the bubble, and therefore, the pressure component thereof is effectively used for the ejection. In addition, the pressure directed upwardly at least in the downstream portion (component force of VB in FIG. 4) functions such that free end portion of the movable member is added to the bubble growth at the downstream end portion. Therefore, the ejection efficiency is improved, similarly to the foregoing embodiment. As compared with the foregoing embodiments, the structure of this embodiment using the head of FIG. 14, is better in the responsivity of the driving of the heat generating element.

In addition, the structure is simple so that manufacturing is easy.

The fulcrum portion of the movable member 31 in this embodiment, is fixed to one foundation 34 having a width smaller than the surface portion of the movable member. Therefore, the liquid supply to the bubble generation region 11 upon the collapse of bubble occurs along both of the lateral sides of the foundation (indicated by an arrow). The foundation may be in another form if the liquid supply performance is assured.

In the case of this embodiment, the existence of the movable member is effective to control the flow into the bubble generation region from the upper part upon the collapse of bubble, the refilling for the supply of the liquid is better than the conventional bubble generating structure having only the heat generating element. The retraction of the meniscus is also decreased thereby.

In a preferable modified embodiment of the embodiment, both of the lateral sides (or only one lateral side) are substantially sealed for the bubble generation region 11. With such a structure, the pressure toward the lateral side of the movable member is also directed to the ejection outlet side end portion, so that ejection efficiency is further improved.

Figure 18:
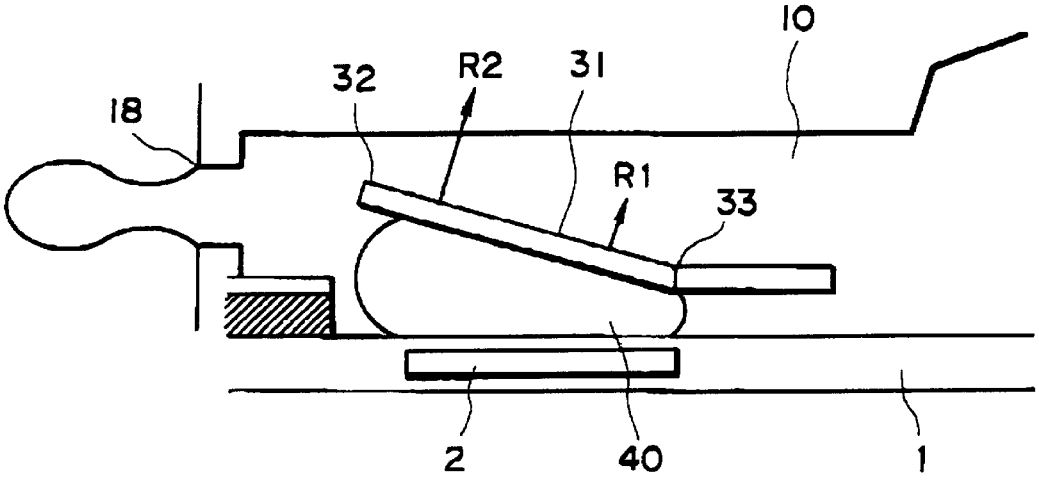
FIG. 18 is a sectional view of a modified example of a liquid ejecting head usable with a head cartridge according to and embodiment of the present invention.

FIG. 18 shows and embodiment wherein the ejection power for the liquid by the mechanical displacement is further enhanced. In FIG. 18, the movable member is extended such that position of the free end of the movable member 31 is positioned further downstream of the ejection outlet side end of the heat generating element. By this, the displacing speed of the movable member at the free end position can be increased, and therefore, the production of the ejection power by the displacement of the movable member is further improved.

In addition, the free end is closer to the ejection outlet side than in the foregoing embodiment, and therefore, the growth of the bubble can be concentrated toward the stabilized direction, thus assuring the better ejection.

In response to the growth speed of the bubble at the central portion of the pressure of the bubble, the movable member 31 displaces at a displacing speed R1. The free end 32 which is at a position further than this position from the fulcrum 33, displaces at a higher speed R2. Thus, the free end 32 mechanically acts on the liquid at a higher speed to increase the ejection efficiency.

The free end configuration is such that, as is the same as in FIG. 16, the edge is vertical to the liquid flow, by which the pressure of the bubble and the mechanical function of the movable member are more efficiently contributable to the ejection.

FIG. 19, (*a*), (*b*) (*c*), shows a further modified example of the ejection head portion of the head cartridge.

In this modified example, the region directly communicating with the ejection outlet does not have the liquid path configuration in communication with the liquid chamber side, by which the structure is simple.

The liquid is supplied only from the liquid supply passage 12 along the surface of the bubble generation region side of the movable member 31. The free end 32 of the movable member 31, the positional relation of the fulcrum 23 relative to the ejection outlet 18 and the structure of facing to the heat generating element 2 are similar to the above-described embodiment.

According to this embodiment, the advantageous effects in the ejection efficiency, the liquid supply performance and so on described above, are accomplished. Particularly, the retraction of the meniscus is suppressed, and a forced refilling is effected substantially thoroughly using the pressure upon the collapse of bubble.

FIG. 19, (*a*) shows a state in which the bubble generation is caused by the heat generating element 2, and FIG. 16, (*b*) shows the state in which the bubble is going to contract. At this time, the returning of the movable member 31 to the initial position and the liquid supply by $S_3$ are effected.

In FIG. 19, (*c*), the small retraction M of the meniscus upon the returning to the initial position of the movable member, is being compensated for by the refilling by the capillary force in the neighborhood of the ejection outlet 18.

Figure 20:
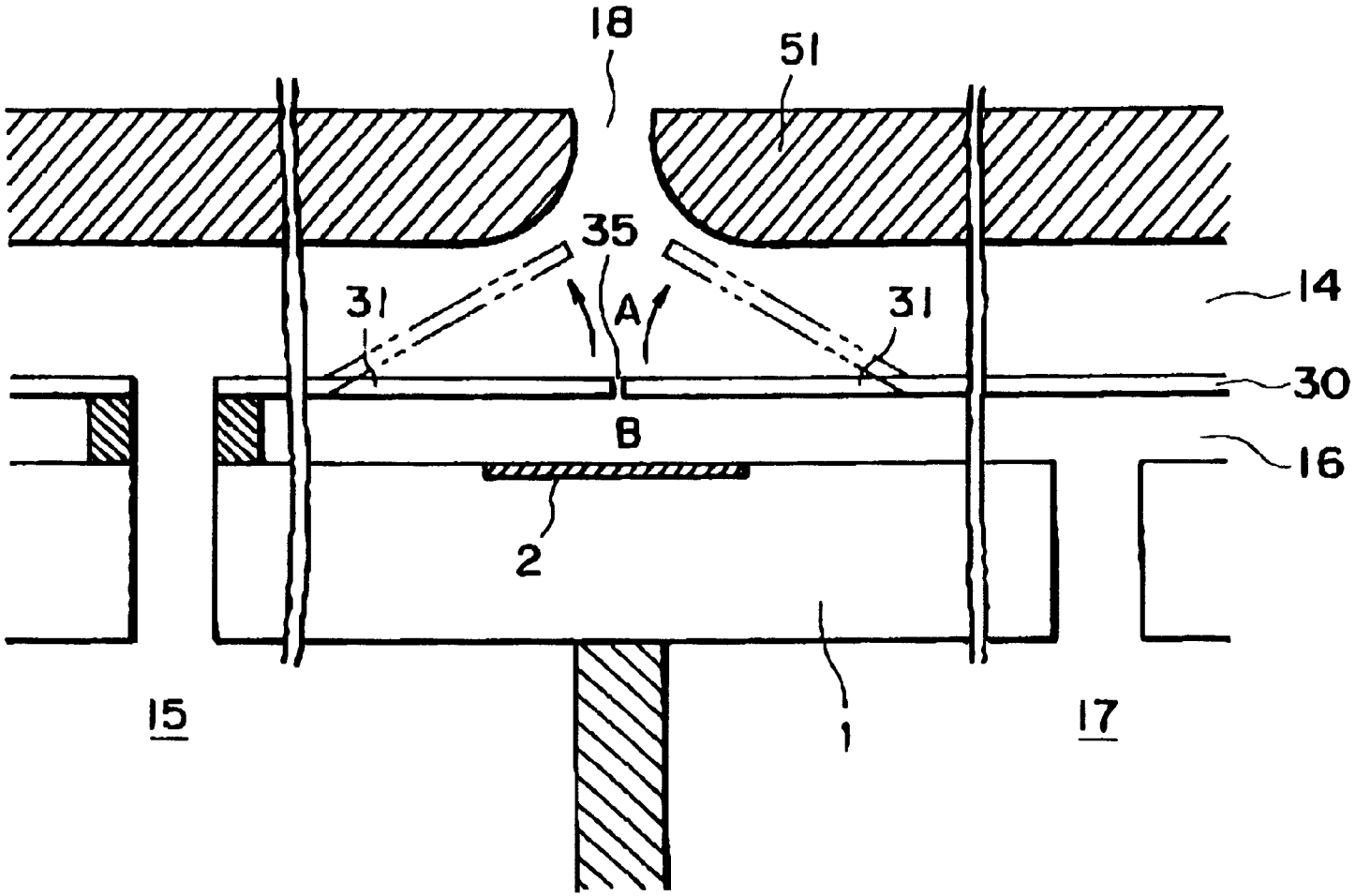
FIG. 20 is a sectional view of a modified example of a liquid ejecting head usable with a head cartridge according to and embodiment of the present invention.

The embodiments and modifications thereof of the present invention is not limited to a so-called edge shooter type head wherein an ejection outlet is provided at one end of the flow path extended along the surface of the heater, but it applicable to a so-called side shooter type head wherein the ejection outlet is provided opposed to the surface of the heater as shown in FIG. 20, for example.

In the side shooter type liquid ejecting head shown in FIG. 20, a substrate 1 is provided with a heat generating a bubble in the liquid therein for each ejection outlet. Above the substrate 1, a second liquid flow path 16 for the bubble generation liquid is formed, and a first liquid flow path 14 for the ejection liquid is formed in direct fluid communication with the ejection outlet 18, the first liquid flow path 14 being formed in a grooved top plate 50. The first liquid flow path 14 is isolated from the second liquid flow path 16 by a separation wall 30 of elastic material such as metal. In these respects, this head is similar to the edge shooter type liquid ejecting head described hereinbefore.

The side shooter type liquid ejecting head is featured by the ejection outlet 18 provided right above the heat generating element 2, in the grooved top plate (orifice plate) 50 disposed above the first liquid flow path 14. In the separation wall 30, there is provided one pair of movable members 31 (double door type) at a portion between the ejection outlet 18 and the heat generating element 2. The both movable members 31 are of cantilever configuration supported by the fulcrum or base portions 31*b*. The free ends 31*a* therefore are disposed opposed to each other with a small space provided by the slit 31C right below the center portion of the ejection outlet 18. At the time of ejection, the movable portions 31, as indicated by arrows in FIG. 41, are opened to the first liquid flow path 14 by bubble generation of the bubble generation liquid in the bubble generating region B, and are closed by contraction of the bubble generation liquid. To the region A, the ejection liquid is refilled from the ejection liquid container which will be described hereinafter, and is prepared for the next bubble generation.

The first liquid flow path 14 and other first liquid flow paths are in fluid communication with an unshown container for retaining the ejection liquid through a first common liquid chamber 15, and the second liquid flow path 16 and other second liquid flow paths are in fluid communication with a container (unshown) for retaining the bubble generation liquid through a second common liquid chamber 17.

In the side shooter type liquid ejecting head having such a structure, the present invention is capable of providing the advantageous effects that refilling of the ejection liquid is improved, and the liquid can be ejected with high ejection pressure and with high ejection energy use efficiency.

Liquid Container

Further modification of the liquid container usable in the head cartridge will be described.

The description will be further made as to the method of producting the negative pressure difference in the two containers in the third to fifth embodiments.

In the third to fifth embodiments, the negative pressure difference is produced by the difference in the configuration of the liquid containing portion, the film thickness thereof and the material thereof, but they may be combined. Additionally to them or solely, the levels of the liquid containing portions may be made different to provide the static head difference.

When the liquid ejecting head and liquid container, it is desirable to prevent erroneous connection therebetween. This is because the mixing of the ejection liquid and the bubble generation liquid may result in the production of burnt deposit on the heat generating element. In the liquid container of the present invention, the positions of the liquid discharge portions are made different, so that static head differences of the liquid containing portion are different, and in addition, the erroneous mounting between the bubble generation liquid container and the ejection liquid container can be avoided. The position of the liquid discharge portion can be selected depending on the configuration of the liquid container, but in consideration of the supply performance of the liquid therein, it is desirably at a lower portion of the container.

In the first to fifth embodiments, the liquid containing portion having a lower internal pressure is used for the ejection liquid, and the liquid containing portion having a higher internal pressure is used for the bubble generation liquid. But, this is not limiting, and the liquid containing portion having a lower internal pressure may be used for the bubble generation liquid, depending on the head structure or the materials of the ejection liquid.

In the third to fifth embodiments, one set of the bubble generation liquid container and the ejection liquid container is used, but a greater number of combinations are usable. For example, one set may be constituted by four ejection liquid containers for black, yellow, magenta and cyan, respectively and one bubble generation liquid container. In the liquid ejecting head used in the present invention, the consumption of the bubble generation liquid is smaller than that of the ejection liquid, and therefore, the bubble generation liquid container may be made common to the colors. By doing so, the space required for the head cartridge and the liquid container can be reduced, and the supply path can be simplified, and the liquid ejection recording device per se can be downsized.

It is not inevitable that head cartridge has at least one ejection liquid container and at least one bubble generation liquid container, and for example, the ejection liquid container which is frequently exchanged is separably mounted on the carriage, and the bubble generation liquid container is set at a different position in the recording device.

In the case of the two-flow-path structure, the bubble generation liquid container is not necessarily responsive to the forced high speed refilling using the pressure upon the bubble collapse, and may be in the form of a conventional liquid container including a negative pressure producing member such as formed urethane resin material.

Modified examples of the pinch-off portion and the air vent usable with the foregoing embodiments, will be described.

Referring to FIG. 1 and FIG. 6, designated by 104 is a welded portion for forming closed space by the inner wall 102. The welded portion is provided by sandwiching the parison for forming the wall of the liquid container, by the metal mold during the blow molding. In the first embodiment, as shown in FIG. 6(*b*), the fused portion 104 in this embodiment looks linear, but the simple linear configuration is not mandatory; the configuration of the fused portion is optional as long as the ink container can be easily extracted from the die. Further, its length does not necessarily have to be limited to the length given in this embodiment; it is optional as long as the fused portion does not extend beyond the lateral walls.

Referring to FIG. 6(*a*), which is a schematic section of the ink container, the ink supply ports are drawn as ink supply ports whose locations do not correspond to the location of the fused portion 104 across the internal space of the ink container. However, when the ink supply ports are disposed at the locations which correspond to the fused portion 104 across the internal space, the fused portions will also be present on the supply ports.

In FIG. 6, a reference number 105 designates an air vent through which air is introduced between the inner shell 102 and the outer shell 101 when the volume of the inner shell 102 decreases in response to the consumption of the ink contained therein. It may be a simple opening or may be constituted of an air flow valve. In FIG. 6, this air vent is a simple opening (hole). The following is other examples.

A small gap 107 of several tens microns between the outer wall and the inner wall adjacent the welded portion 104 is used for the air introduction inlet. By selecting, as a material of the inner wall 102, a material which exhibits low adhesiveness to the outer wall 101, the gap is provided by applying external force tot welded portion 104 to separate the inner wall 102 from the outer wall 101.

By using different materials for the outer wall 101 and the inner wall 102, residual stress may be used to separate the inner wall from the outer wall to provide the gap 107, similarly to the above example.

In any of the above examples, a valve openable to the outside may be provided in the outer wall of the liquid container to assist the pressure balance of the inner wall of the liquid container. In the normal supply of the liquid, the air is introduced into the space between the inner wall 102 and the outer wall 101 through the gap, and this is enough for proper pressure adjustment. However, the provision of the valve is effective to quickly accommodate the sudden pressure change due to falling.

Lastly, liquid container modifications for the portions other than the walls will be described.

Figure 21A:
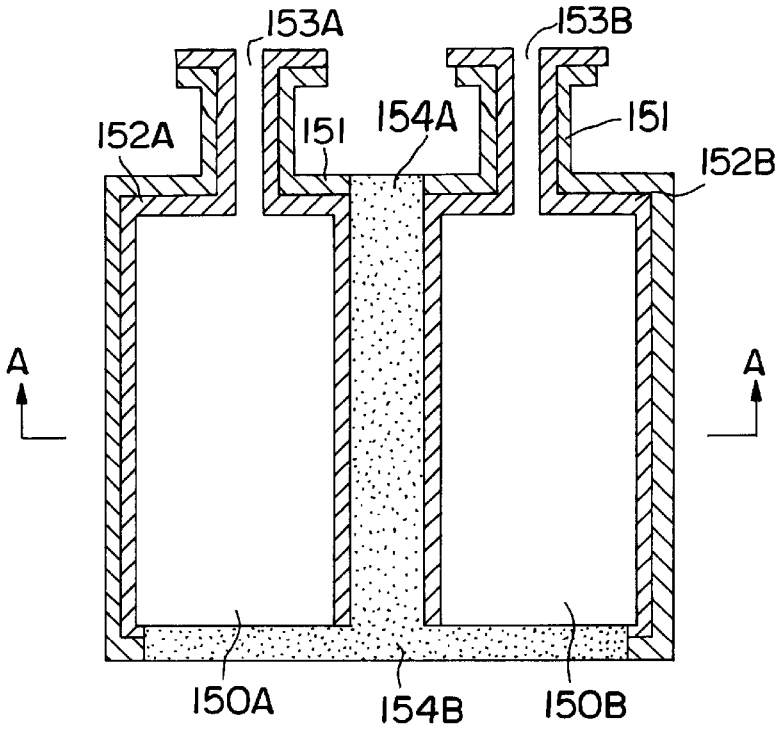
FIGS. 21(*a*) and 21(*b*) are schematic sectional views of a modified example of a liquid container usable with an embodiment of the present invention.
Figure 21B:
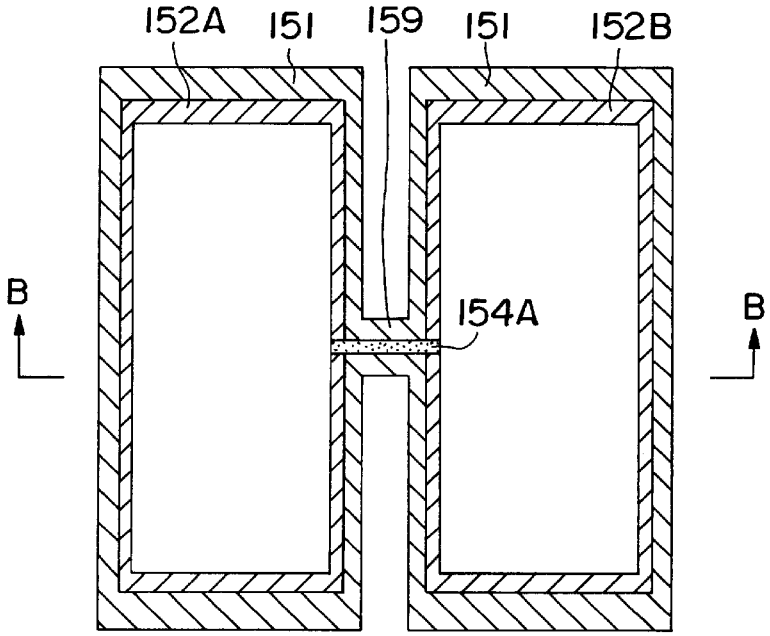

FIG. 21, (*a*) and (*b*) are schematic sections of a liquid container compatible with the second embodiment of the present invention. FIG. 21, (*a*) is a sectional view at a plane parallel to the largest wall of the liquid container, and FIG. 21, (*b*) is a section at a plane A—A in FIG. 21, (*a*), whereas FIG. 21, (*a*) is a section at a plane B—B in FIG. 21, (*b*).

The liquid container illustrated in FIG. 21 comprises two cells 150*a* and 150*b* and a joint portion 159. The joint portion 159 is structured like the pinch-off portion of the liquid container described in the preceding embodiments; the portions which corresponds to the internal walls of the two containers in the preceding embodiments are welded together, forming a fused portion 154*a* which is sandwiched by the external wall. The fused portion 154*a* is integral with a portion 154*b* which corresponds to the pinch-off portion of the head cartridge described in the preceding embodiments, rendering the two cells 150*a* and 150*b* substantially independent from each other, except that they are connected by the fused portion 154*a*; therefore, the liquid in each cell does not mix with the liquid in the other cell. As for the introduction of atmospheric air into the space between the internal and external walls of each cell, the gap created between the internal and external walls at a location adjacent to the portion 154*b* is utilized.

In the case of the liquid container illustrated in FIG. 21, one of the two largest walls of each cell opposes one of the two largest walls of the other cell, and these opposing two walls are connected with the joint portion 159, as illustrated in FIG. 21, (*b*). Therefore, the largest walls which are not connected with the joint portion 159 mainly deform, which is different from the way the liquid containers described in the first and second embodiments deform. However, the thickness distribution of the walls which mainly deform is the same as that in the first and second embodiments; the center portion is thicker than the corners. Therefore, the liquid contained in this liquid container can be fed out as stably as described in the first and second embodiments.

The two cells in the liquid container illustrated in FIG. 21 can be integrally formed using a single mold in the following manner. That is, a cylindrical parison which integrally comprises the internal and external wall portions is prepared during one of the manufacturing steps for the liquid container described in the first embodiment. This parison is sandwiched between two E-shaped molds, and then, air is blown in. Therefore, the liquid container has merit in that manufacturing process can be simplified compared to the liquid container described in the second embodiment. Further, the location of the joint portion 159 between the two cells can be optionally changed by devising the mold shape. Also, a liquid outlet may be attached to the largest wall of each cell as long as one of the largest walls of each cell is enabled to deform in the same manner as one of the largest walls of each cell of this liquid container does.

In the first to fifth embodiments, it was stated that the external wall might double as a housing for a liquid container. However, a housing may be eliminated by employing the liquid container illustrated in FIG. 22.

Figure 22A:
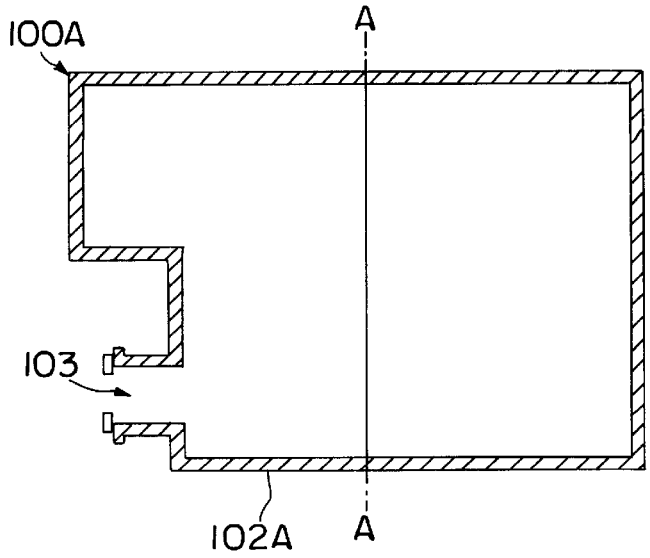
FIGS. 22(*a*) to 22(*c*) are schematic sectional views of a modified example of a liquid container usable with an embodiment of the present invention.
Figure 22B:
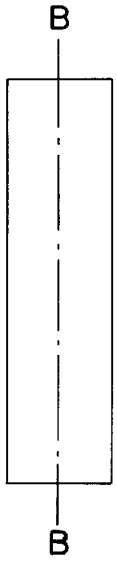
Figure 22C:
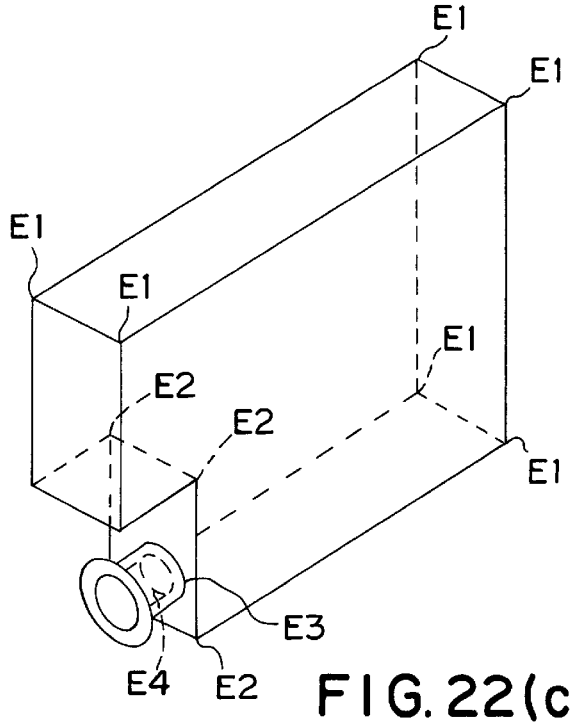
Figure 23A:
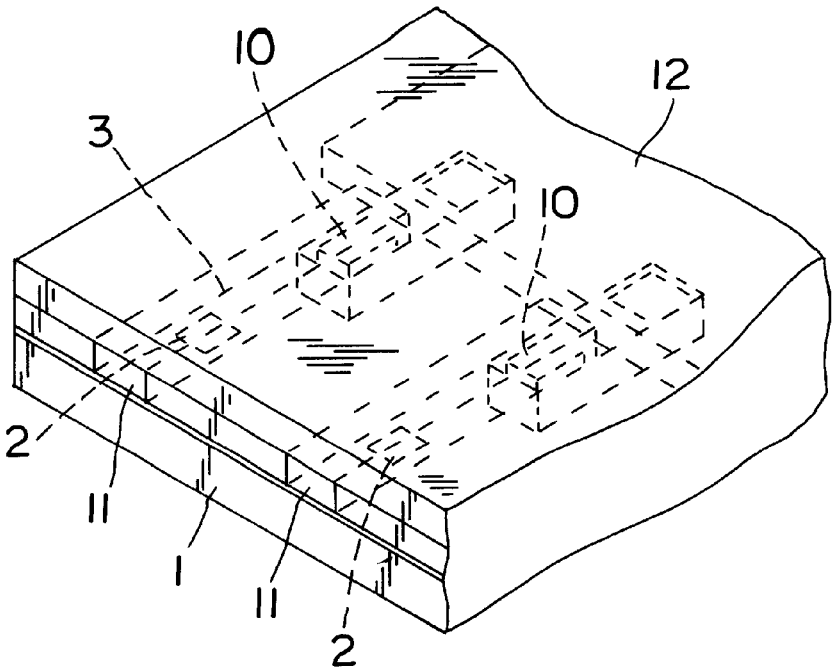
FIGS. 23(*a*) and 23(*b*) are illustrations of a liquid flow passage structure of a conventional liquid ejecting head.
Figure 23B:
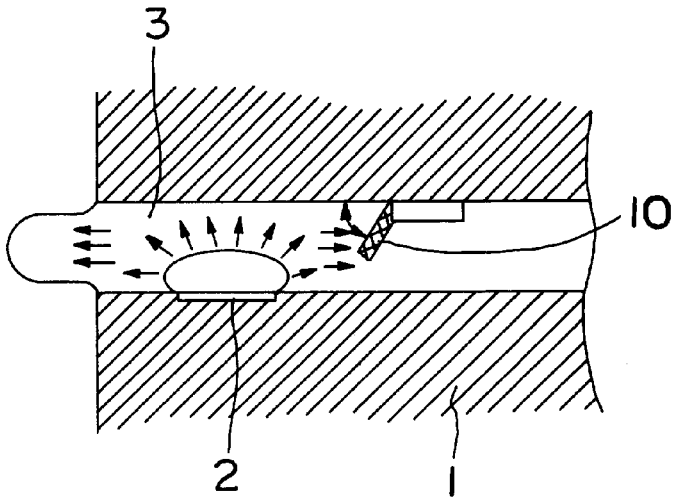

In FIG. 22, (*a*) is a sectional view; (*b*), a side view; and (*c*) is a perspective view.

In this modification, the internal or external wall is removed, or the liquid container is given a single wall structure.

As for the method for manufacturing a liquid container in accordance with this modification, a blowing molding method which uses air is employed. In the case of the blow molding described in the first to fifth embodiments, tow parisons which are different in resin material are extruded into the mold during one of the manufacturing steps using a main extruder and an auxiliary extruder, whereas in this embodiment, only the main extruder is used to form the liquid container employing only one resin material. Needless to say, two resin materials may be combined to form a liquid container in accordance with this modification, in consideration of resistance to the liquid to be contained, and gas permeability.

In the case of a liquid container in accordance with this modification, it is unnecessary to provide the liquid container with an air vent. Also, there is no exterior wall which regulates the movement of the corner portions of the liquid container.

Further, the pinch-off portion, which is omitted in the drawing, is not positioned on the largest wall so that the thickness of the largest wall becomes gradually decreases from the center portion toward each corner portion. Further, when the wall of a liquid container in accordance with this modification is given a laminar structure having an internal layer and an external layer, the thickness distribution of the external layer of the largest wall is rendered so that the internal layer in contact of this external layer is concaved. Thus, the largest wall of the container is allowed to smoothly deform, increasing the depth of the "concave", in response to the change in the internal negative pressure of the ink container.

Although the corner portions of the liquid container are also displaced toward the center portion of the largest wall as the liquid within the liquid container is consumed, their shapes remain intact while the center portions of the opposing two largest walls eventually make contact with each other, and the contact area between two walls gradually spreads toward each corners. This deformational regularity which this modification provides qualifies a liquid container in accordance with this modification as a desirable liquid container for a liquid ejecting head cartridge.

The liquid container illustrated in FIG. 22 is satisfactory in terms of one of the characteristics required of a desirable liquid container for a liquid ejecting head cartridge, that is, it is capable of stably feeding out liquid. However, it is vulnerable to the external shocks which occur during transporation or the like. Therefore, it is desirable that this liquid container is provided with a housing which enclose the container.

Next, the structures of the "external walls" in the preceding embodiments, and the effects which they give to the structure of the "internal walls " will be described with reference to one of the manufacturing methods for the liquid container in accordance with the modification illustrated in FIG. 22.

As for a simple method for producing the liquid container illustrated in FIG. 22, it is conceivable to use the above described blow molding with a condition that the mold is enabled to provide a liquid container with a predetermined curvature. The usage of this type of direct blow molding was already described above while describing the method for producing the liquid container in accordance with the modification illustrated in FIG. 22, which employs either the material for the external wall or the material for the internal wall.

At this time, the ink containers in the preceding embodiments will be further described.

The external and internal walls of the liquid containers in the preceding embodiments, which are formed using the direct blow molding, and separable from each other, have substantially the same structure. This is due to the fact that they both are formed by uniformly expanding a cylindrical parison against a polygonal column mold with the use of air.

In other words, the thickness of the internal wall adjacent to the corner portions of the liquid container is less than the thickness of the center portion of the internal wall. This is also true with the external wall.

In addition, during manufacturing, the internal wall is laminated on the external wall which has such thickness distribution that the thickness of the wall gradually decreases from the center portion toward each corner; the outward surface of the internal wall remains perfectly in contact with the inward surface of the external wall. In other words, the outward surface of the internal wall conforms to the thickness distribution of the external wall. Therefore, the inward surface of the internal wall, which inherently curves inward of the liquid container due to its own thickness distribution, curves further inward. Since this wall structure in accordance with the present invention is most effective when applied to the largest wall of a liquid container, only the largest wall of a liquid container has to be provided with this wall structure in order for the liquid container to desirably function. The depth of the concave formed by the inward surface of the internal wall may be no more than 2 mm from the imaginary straight internal wall, whereas the depth of the concave formed by the outward surface of the internal wall may be no more than 1 mm from the imaginary straight internal wall. In the case of the smaller wall of a liquid container, the depth of the wall concave may fall within a range of measurement error, but such a condition is one of the desirable conditions for the present invention, since the depth of the concave of each wall is one of the factors which affect the order of priority in wall deformation.

Next, the structure of the external wall will be further described. As for the functions of the external wall, regulating the deformation of the corner portions of the internal walls was listed previously as one of them. In order to regulate the deformation of the corner portions of the internal walls, the external wall has to cover only the corner portions of the internal walls, so that the liquid container is enabled to maintain substantially the original shape. For this purpose, the external wall or the internal wall may be covered with plastic plate, metallic plate, card board, or the like. The external wall may entirely cover the internal wall. It may constitute a corner covering member which is placed only at the corner portions of the internal walls, wherein each corner covering member is connected to the adjacent corner covering members by a metallic rod or the like. Further, it may be formed or meshed material.

As for the desirable material for a liquid container in accordance with the present invention, polyethylene, polypropylene, or the like, is usable, but the tensile elastic coefficient of the material to be used for the internal wall should be within a range of 150–3000 (kgf/cm$^2$).

The material may be optionally selected in view of the conditions such the configuration of a liquid container, the thickness of the container wall, the negative pressure required of the container, as long as the numerical value of the tensile elastic coefficient of the selected material is within the range given above.

In the preceding embodiments, the external and internal walls of the liquid containers were described as a single layer wall. However, they may be given one of various laminar structures to improve shock resistance. In particular, providing the exterior wall with a laminar structure can prevent a liquid container from being damaged while the liquid container is transported or mounted.

By the multi-layer structure of the outer wall, the damage possible during transportation or mounting can be avoided.

As described in the foregoing, according to the present invention, there is provided a head cartridge wherein the liquid can be accommodated efficiently in a limited space, and the service life is long with less frequent exchange.

With the improved refilling property, the present invention accomplishes high responsivity during the continuous ejection, stable growth of the bubble and the stabilized droplet, and accomplishes high speed recording with the high speed liquid ejection with high image quality.

In the two-flow-path structure head, liquid easy to generate a bubble is used for the bubble generation liquid, or liquid which produces less burnt deposit on the heat generating element, and the liquid container therefor is use, the selectable range of the ejection liquid is so wide that height viscous liquid which does not easily generate the bubble, liquid which tends to produce the burnt deposit on the heat generating element, liquid from which a content is easily separated when an absorbing material is used in the liquid containing portion, or like liquid which is not easily used with the conventional head cartridge can be ejected. Liquid which is easily influenced by heat could be ejected without the influence.

According to an embodiment of the present invention, the first liquid flow path and the second liquid flow path substantially isolated by a movable member are different. By this, the height viscous ink can be stably ejected; the refilling of the liquid which generate the bubble is improved; the upper and lower liquids are prevented from mixing when the head is not operated, so that ejection performance is high at the time of record operation start, and the ejection liquid if prevented form reaching the heat generating element beyond the movable member during the operation.

By manufacturing the liquid containing portion of the head cartridge through blow molding, the pressure difference between the flow paths, can be provided by a simple structure, and the accommodation efficiency is improved, and the manufacturing cost is low.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejecting head cartridge comprising:

a liquid ejecting head comprising: an ejection outlet for rejecting the liquid; a bubble generation region for generating a bubble in the liquid; and a movable member disposed faced to said bubble generation region and displaceable between a first position and a second position further from said bubble generation region than the first position; wherein said movable member moves from said first position to said second position by pressure produced by the generation of the bubble to permit expansion of the bubble more in a downstream side closer to an ejection outlet than in an upstream side; and a liquid container comprising: a substantially prism-like outer wall provided with a substantial air vent portion and having a corner formed by three surfaces; and an inner wall having a prism-like shape with outer surfaces substantially equivalent to inside surfaces of said outer wall and a corner portion corresponding to the corner of said outer wall, said inner wall being separable from said outer wall and defining a liquid accommodating portion for containing the liquid to be supplied to said liquid ejection head therein, said inner wall further having a liquid supply portion for supplying the liquid out of said liquid accommodating portion to said liquid ejection head; wherein said inner wall has a thickness which is smaller in the corner portion than a thickness of a central portion of the outer surfaces of the inner wall.

2. An apparatus according to claim 1, wherein said inner wall and said outer wall each have a maximum area side other than sides having said liquid supply portion or pinch-off portion.

3. An apparatus according to claim 1, wherein said liquid ejecting head and said liquid container are separable from each other.

4. A liquid ejecting head cartridge comprising:

a liquid ejecting head comprising: a heat generating element for generating a bubble in the liquid by applying heat to said liquid; a liquid flow path having a supply passage for supplying the liquid to said heat generating element from upstream thereof; and a movable member disposed faced to said heat generating element and having a free end adjacent said ejection outlet, the free end of said movable member being moved by pressure produced by the generation of the bubble to guide the pressure toward said ejection outlet; and a liquid container comprising: a substantially prism-like outer wall provided with a substantial air vent portion and having a corner formed by three surfaces; and an inner wall having outer surfaces substantially equivalent to inside surfaces of said outer wall and a corner portion corresponding to the corner of said outer wall, said inner wall being separable from said outer wall and defining a liquid accommodating portion for containing the liquid to be supplied to said liquid ejection head therein, said inner wall further having a liquid supply portion for supplying the liquid out of said liquid accommodating portion to said liquid ejection head; wherein with consumption of the liquid from said liquid accommodating portion, a central portion of an outer surface of said inner wall having a maximum area deforms, and a corner portion corresponding to the outer surface having the maximum area separates from a corresponding corner portion of said outer wall while maintaining a shape of the corner portion.

5. A liquid ejecting head cartridge comprising:

a liquid ejecting head comprising: a heat generating element for generating a bubble in the liquid by applying heat to said liquid; a liquid flow path having a supply passage for supplying the liquid to said heat generating element from upstream thereof; and a movable member disposed faced to said heat generating element and having a free end adjacent said ejection outlet, the free end of said movable member being moved by pressure produced by the generation of the bubble to guide the pressure toward said ejection outlet;

a liquid passage for supplying the liquid to said heat generating element from upstream along such a side of said movable member as is closer to said heat generating element; and a liquid container comprising: a substantially prism-like outer wall provided with a substantial air vent portion and having a corner formed by three surfaces; an inner wall having a prism-like shape with outer surfaces substantially equivalent to inside surfaces of said outer wall and a corner portion corresponding to the corner of said outer wall, said inner wall being separable from said outer wall and defining a liquid accommodating portion for containing the liquid to be supplied to said liquid ejection head therein, said inner wall further having a liquid supply portion for supplying the liquid out of said liquid accommodating portion to said liquid ejection head; wherein each side of said outer wall is convex toward said liquid accommodating portion, and each side of said inner wall has a thickness which is smaller in the corner portion than a thickness of a central portion of the outer surfaces of the inner wall.

6. A liquid ejecting head comprising:

a liquid ejecting head comprising: a first liquid flow path in fluid communication with an ejection outlet; a second liquid flow path having a bubble generation region for generating a bubble in the liquid by applying heat to the liquid; and a movable member disposed between said first liquid flow path and said bubble generation region and having a free end adjacent the ejection outlet, wherein the free end of the movable member is displaced into said first liquid flow path by pressure produced by the generation of the bubble, thus guiding the pressure toward the ejection outlet of said first liquid flow path by the movement of the movable member to eject the liquid; and a liquid container comprising: a liquid accommodating member having a corner formed by three surfaces; a corner enclosing member for constraining movement of the corner of said liquid accommodating member while permitting movement thereof without substantial deformation of the corner, a shape of said corner enclosing member being maintained against deformation of said liquid accommodating member; and a liquid supply port for supplying the liquid out of said liquid accommodating member; wherein said liquid accommodating member has a thickness which is smaller at the corner than that at a central portion of the surfaces of the liquid accommodating member.

7. A liquid ejecting cartridge comprising:

a liquid ejecting head comprising: a grooved member integrally having a plurality of ejection outlets for ejecting the liquid, a plurality of grooves for forming a plurality of first liquid flow paths in direct fluid communication with said ejection outlets, and a recess for forming a first common liquid chamber for supplying the liquid to said first liquid flow paths;

an element substrate having a plurality of heat generating elements for generating a bubble in the liquid by applying heat to the liquid; a partition wall disposed between said grooved member and said element substrate and forming a part of walls of second liquid flow paths corresponding to said heat generating elements; and a movable member into said first liquid flow paths by pressure produced by the generation of the bubble, said movable member being faced to said heat generating element; and a liquid container comprising: a substantially prism-like outer wall provided with a substantial air vent portion and having a corner formed by three surfaces; and an inner wall having outer surfaces substantially equivalent to inside surfaces of said outer wall and a corner portion corresponding to the corner of said outer wall, said inner wall being separable from said outer wall and defining a liquid accommodating portion for containing the liquid to be supplied to first and second liquid passages of said liquid ejection head therein, said inner wall further having a liquid supply portion for supplying the liquid out of said liquid accommodating portion to said liquid ejection head; wherein said inner wall has pinch-off portions sandwiched by said outer wall, wherein said inner wall has a thickness which is smaller in the corner portion than a thickness of a central portion of the outer surfaces of the inner wall, and said pinch-off portions are provided in opposing sides.

8. An apparatus according to claim 7, wherein a thickness of said inner wall decreases gradually from a central portion of each surface to corners portions of each surface.

9. An apparatus according to claim 7, wherein said corner portions are rounded.

10. A liquid ejecting head cartridge comprising:

a liquid ejecting head comprising: a grooved member integrally having a plurality of ejection outlets for ejecting the liquid, a plurality of grooves for forming a plurality of first liquid flow paths in direct fluid communication with said ejection outlets, and a recess for forming a first common liquid chamber for supplying the liquid to said first liquid flow paths; an element substrate having a plurality of heat generating elements for generating a bubble in the liquid by applying heat to the liquid; a partition wall disposed between said grooved member and said element substrate and forming a part of walls of second liquid flow paths corresponding to said heat generating elements; and a movable member movable into said first liquid flow paths by pressure produced by the generation of the bubble, said movable member being faced to said heat generating elements;

a first liquid container for accommodating the liquid to be supplied to said first liquid passage; and a second liquid container for accommodating the liquid to be supplied to said second liquid flow path;

wherein said first liquid container comprises: a substantially prism-like outer wall provided with a substantial air vent portion and having a corner formed by three surfaces; and an inner wall having a prism-like shape with outer surfaces substantially equivalent to inside surfaces of said outer wall and a corner portion corresponding to the corner of said outer wall, said inner wall being separable from said outer wall and defining a liquid accommodating portion for containing the liquid to be supplied to said liquid ejection head therein, said inner wall further having a liquid supply portion for supplying the liquid out of said liquid accommodating portion to said liquid ejection head; wherein said inner wall has pinch-off portions sandwiched by said outer wall, wherein said inner wall has a thickness which is smaller in the corner portion than a thickness of a central portion of the outer surfaces of the inner wall, and said pinch-off portions are provided in opposing sides.

11. An apparatus according to claim 10, wherein said first liquid container and said second liquid container provide different internal pressure at the liquid supply portion.

12. An apparatus according to claim 10, wherein pressure levels within said first and second liquid containers are different.

13. An apparatus according to claim 10, wherein said liquid ejecting head is separable from each of said first and second liquid containers.

14. An apparatus according to claim 13, wherein said first and second liquid containers are provided with erroneous mounting prevention mechanisms.

15. An apparatus according to claim 10, further comprising a second liquid container, the second liquid container comprising a substantially prism-like outer wall provided with a substantial air vent portion and having a corner formed by three surfaces; and an inner wall having a prism-like shape with outer surfaces equivalent to inside surfaces of said outer wall and a corner portion corresponding to the corner of said outer wall, said inner wall being separable from said outer wall and defining a liquid accommodating portion for containing the liquid to be supplied to first and second liquid passages of said liquid ejection head therein, said inner wall further having a liquid supply portion for supplying the liquid out of said liquid accommodating portion to said liquid ejection head; wherein said inner wall has pinch-off portions sandwiched by said outer wall, wherein said inner wall has a thickness which is smaller in the corner portion than a thickness of a central portion of the outer surfaces of the inner wall.

16. An apparatus according to claim 15, wherein said first and second liquid containers have different inside volumes.

17. An apparatus according to claim 15, wherein said first liquid container and second liquid container are of different materials.

18. An apparatus according to claim 15, wherein each of said inner wall and said outer wall of each of said first and second liquid containers has an outer surface having a maximum area, the outer surface having the maximum area different from an outer surface having said liquid supply portion or pinch-off portion.

19. An apparatus according to claim 18, wherein said inner wall of said first liquid container and said inner wall of said second liquid container have different thicknesses at a central portion of said outer surfaces having maximum areas.

20. An apparatus according to claim 18, wherein the maximum areas of said first liquid container and second liquid container are different.

21. A liquid container for a liquid ejecting head, said liquid ejecting head comprising: an ejection outlet for rejecting the liquid; a bubble generation region for generating a bubble in the liquid; and a movable member disposed faced to said bubble generation region and displaceable between a first and a second position further from said bubble generation region than the first position; wherein said movable member moves from said first position to said second position by pressure produced by the generation of the bubble to permit expansion of the bubble more in a downstream side closer to the ejection outlet than in an upstream side, the liquid container comprising:

a corner portion constituted by extensions of three sides of a prism configuration;

a liquid supply portion for supplying the liquid; and a casing covering at least a part of the liquid supply portion;

wherein configuration of the corner portion is maintained until sides of the liquid container having maximum areas are brought into contact with each other.

22. A liquid container for a liquid ejecting head, said liquid ejection head comprising: an ejection outlet for ejecting the liquid; a heat generating element for generating a bubble in the liquid by applying heat to said liquid; a liquid flow path having a supply passage for supplying the liquid to said heat generating element from upstream thereof; and a movable member disposed faced to said heat generating element and having a free end adjacent said ejection outlet, the free end of said movable member being moved by pressure produced by the generation of the bubble to guide the pressure toward said ejection outlet, the liquid container comprising:

a first liquid containing portion for accommodating the liquid to be supplied to said first flow path; and a second liquid containing portion for accommodating the liquid to be supplied to said second liquid flow path;

wherein each of said first and second liquid containing portions has a corner constituted by three surfaces which are arranged in a prism-like configuration;

a liquid supply portion for supplying the liquid; and an outer wall having an inner surface substantially equivalent to the outer surface of the liquid containing portions, and corner portions corresponding to the corner portions of said liquid containing portions;

wherein the outer wall of said first liquid containing portion and the outer wall of the second liquid containing portion are integral with each other, and wherein a film thickness of a portion constituting the corner portion, for each of said first and second liquid containing portions, is larger than a film thickness of a central portion.

23. An apparatus according to claim 22, wherein casing movably confines the corner of each of said first accommodating portion and said second accommodating portion while maintaining a configuration of the corner, and maintains its configuration against deformation of said accommodating portions.

24. An apparatus according to claim 22, wherein all of two sides out of three sides constituting the corner, are substantially perpendicular.

25. A liquid container for a liquid ejection head, said liquid ejection head comprising: a grooved member integrally having a plurality of ejection outlets for ejecting the liquid, a plurality of grooves for forming a plurality of first liquid flow paths in direct fluid communication with said ejection outlets, and a recess for forming a first common liquid chamber for supplying the liquid to said first liquid flow paths; an element substrate having a plurality of heat generating elements for generating a bubble in the liquid by applying heat to the liquid; a partition wall disposed between said grooved member and said element substrate and forming a part of walls of second liquid flow paths corresponding to said heat generating elements; and a movable member movable into said first liquid flow paths by pressure produced by the generation of the bubble, said movable member being faced to said heat generating element, the liquid container comprising:

first and second accommodating portions for accommodating the liquid to be supplied to said first liquid passage and the liquid to be supplied to said second liquid flow path;

each of said first and second liquid containers, comprising: a substantially prism-like outer wall provided with a substantial air vent portion and having a corner formed by three surfaces; and an inner wall having a prism-like shape with outer surfaces substantially equivalent to inside surfaces of said outer wall and a corner portion corresponding to the corner of said outer wall, said inner wall being separable from said outer wall and defining a liquid accommodating portion for containing the liquid to be supplied to first and second liquid passages of said liquid ejection head therein, said inner wall further having a liquid supply portion for supplying the liquid out of said liquid accommodating portion to said liquid ejection head; wherein said inner wall has pinch-off portions sandwiched by said outer wall, and wherein said inner wall has a thickness which is smaller in the corner portion than a thickness of a central portion of the outer surfaces of the inner wall;

wherein liquid supply pressures of the liquid supplied from said first liquid containing portion to said first liquid flow path and the liquid supplied from the second accommodating portion to said second liquid flow path are different.

26. A liquid container for a liquid ejecting head, said liquid ejection head comprising: a grooved member integrally having a plurality of ejection outlets for ejecting the liquid, a plurality of grooves for forming a plurality of first liquid flow paths in direct fluid communication with said ejection outlets, and a recess for forming a first common liquid chamber for supplying the liquid to said first liquid flow paths; an element substrate having a plurality of heat generating elements for generating a bubble in the liquid by applying heat to the liquid; a partition wall disposed between said grooved member and said element substrate and forming a part of walls of second liquid flow paths corresponding to said heat generating elements; and a movable member movable into said first liquid flow paths by pressure produced by the generation of the bubble, said movable member being faced to said heat generating element, the liquid container comprising:

a first accommodating portion for accommodating the liquid to be supplied to said first liquid flow path;

a second accommodating portion for accommodating the liquid to be supplied to said second liquid flow path; and a casing covering at least a part of said first and second accommodating portions;

wherein said first and second accommodating portions are each in a form of a prism configuration, and each has a corner constituted by three sides thereof, and a liquid supply portion for supplying the liquid to said liquid ejecting head, and wherein a configuration of the corner is maintained until sides having maximum areas are brought into contact with each other; and wherein liquid supply pressures the liquid supplied from said first liquid containing portion to said first liquid flow path and the liquid supplied from said second accommodating portion to said second liquid flow path are different.

* * * * *

UNITED STATES PATENT AND TRADEMARK OFFICE

CERTIFICATE OF CORRECTION

PATENT NO. : 6,247,806 B1
DATED : June 19, 2001
INVENTOR(S) : Matsumoto et al.

It is certified that error appears in the above-identified patent and that said Letters Patent is hereby corrected as shown below:

Title page,
Item [56], References Cited: "4-267727" should read -- 4-267727 --; and "4339759" should read -- 4-339759 --.

Column 1,
Line 12, "displace" should read -- displaced --;
Line 28 "With such" should read -- Such --; and
Line 29, "sped" should read -- speed --.

Column 2,
Line 2, "stick" should read -- sticks --;
Line 10, "no" should read -- not --;
Line 39, "silicon" should read -- silicone --;
Line 59 "Inn" should read -- In --; and
Line 67, "or" should read -- or the --.

Column 3
Line 43, "a" (second occurrence) should read -- and --;
Line 54, "refreshing a" should read -- a refreshing --;
Line 61, "value," should read -- volume, --; and
Line 65, "some" should read -- The case --.

Column 4,
Line 29, "the" (second occurrence) should read -- to the --; and
Line 53, "the" (first occurrence) should read -- to the --.

Column 5,
Line 16, "the" (first occurrence) should read -- to the --.

Column 6,
Line 7, "the (first occurrence) should read -- to the --;
Line 13, "a" should be deleted;
Line 43, "the" (first occurrence) should read -- to the --; and
Line 49, "a" should be deleted;

UNITED STATES PATENT AND TRADEMARK OFFICE

CERTIFICATE OF CORRECTION

PATENT NO. : 6,247,806 B1
DATED : June 19, 2001
INVENTOR(S) : Matsumoto et al.

It is certified that error appears in the above-identified patent and that said Letters Patent is hereby corrected as shown below:

Column 7,
Line 20, “and” should read -- and second --;
Line 55, ““the” (second occurrence) should read -- to the --; and
Line 62, “a” should be deleted.

Column 9,
Line 11, “function” should read -- functions --.

Column 14,
Line 19, “sated” should read -- state --.

Column 16,
Line 17, “b” should read -- by --;
Line 21 “$s_1$,” should read -- $S_1$, --; and
Line 65, “FIG. 6, (a) to (c) is” should read -- FIGs. 6(a) to 6(c) are --.

Column 17,
Line 4, “shown in “ should read -- shown --; and
Line 8, “vies” should read -- views --.

Column 18,
Line 34 “form” should read -- from --; and
Line 37, “deforms” should read -- deform --.

Column 19,
Line 7, “spondence” should read -- sponding --;
Line 24, “to” should be deleted; and
Line 46, “are” should read -- area --.

Column 20,
Line 51, “are” should read -- is --.

Column 21,
Line 43, “withstand” should read -- withstands --.

UNITED STATES PATENT AND TRADEMARK OFFICE

CERTIFICATE OF CORRECTION

PATENT NO. : 6,247,806 B1
DATED : June 19, 2001
INVENTOR(S) : Matsumoto et al.

It is certified that error appears in the above-identified patent and that said Letters Patent is hereby corrected as shown below:

Column 22,
Line 3, “approx,” should read -- approx. --;
Line 10, “a” should read -- an --; and
Line 38, “material. With” should read -- material, with --.

Column 23,
Line 14, “close” should be deleted;
Line 23, “corner,”should read -- corner --;
Line 28, “effect” should read -- effected --;
Line 31, “decreases.” should read -- decreased. --; and
Line 58, “simplify” should read -- simplifying --.

Column 24,
Line 7, “eluded” should read -- eluted --;
Line 21, “high” should read -- a higher --;
Line 28, “respond” should read -- respond to --;
Line 42, “head” should read -- heat --;
Lines 48 and 50, “is” should read -- are --; and
Line 55, “sinner” should read -- inner --.

Column 25,
Line 34, “extend” should read -- extent --;
Line 56, “are” should read -- it is --; and
Line 65, “sued ejection liquid” should read -- ejection liquid used --.

Column 26,
Line 13, “15” should read -- 16 --.

Column 27,
Line 7, “is” should read -- are --;
Line 35, “last” should read -- lasts --; and
Line 57, “(A);” should read -- (a); --.

UNITED STATES PATENT AND TRADEMARK OFFICE

CERTIFICATE OF CORRECTION

PATENT NO. : 6,247,806 B1
DATED : June 19, 2001
INVENTOR(S) : Matsumoto et al.

It is certified that error appears in the above-identified patent and that said Letters Patent is hereby corrected as shown below:

Column 28,
Line 8, “a” should be deleted.

Column 30,
Line 24 “internals wall” should read -- internal walls --; and
Line 37, “which” should read -- which are --.

Column 31,
Line 11, “can” should read -- can be --; and
Line 23, “embodiment,” should read -- embodiments, --.

Column 33,
Line 57, “is” should read -- are --;
Line 59, “it” should read -- are --; and
Line 65, “a” should read -- element 2 for generating thermal energy for generating a --.

Column 36,
Line 4, “tot” should read -- to the --; and
Line 31, “corresponds” should read -- correspond --.

Column 37,
Line 19, “tow” should read -- two --;
Line 36, “becomes” should be deleted; and
Line 53, “corners.” should read -- corner. --.

UNITED STATES PATENT AND TRADEMARK OFFICE

CERTIFICATE OF CORRECTION

PATENT NO. : 6,247,806 B1
DATED : June 19, 2001
INVENTOR(S) : Matsumoto et al.

It is certified that error appears in the above-identified patent and that said Letters Patent is hereby corrected as shown below:

Column 39,
Line 37, "use," should read -- used, --;
Line 38,"height" should read -- highly --;
Line 51, "generate" should read -- generates --;
Line 54, "if" should read -- is --; and
Line 55, "form" should read -- from --.

Signed and Sealed this

Thirtieth Day of July, 2002

*Attest:*

*Attesting Officer*

JAMES E. ROGAN
*Director of the United States Patent and Trademark Office*